US012376660B2

(12) United States Patent
Higgins et al.

(10) Patent No.: US 12,376,660 B2
(45) Date of Patent: Aug. 5, 2025

(54) HOT BRUSH

(71) Applicant: SharkNinja Operating LLC, Needham, MA (US)

(72) Inventors: Colby Jackson Higgins, Randolph, MA (US); Gentian Rrudho, Natick, MA (US); Katelyn Lee Walter, West Roxbury, MA (US); Molly McGuinness, Brighton, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/098,086

(22) Filed: Jan. 17, 2023

(65) Prior Publication Data

US 2024/0237798 A1 Jul. 18, 2024

(51) Int. Cl.

| | |
|---|---|
| ***A45D 20/12*** | (2006.01) |
| ***A45D 2/00*** | (2006.01) |
| ***A45D 20/48*** | (2006.01) |
| ***A46B 15/00*** | (2006.01) |

(52) U.S. Cl.

CPC ..... *A45D 20/12* (2013.01); *A45D 2/001* (2013.01); *A45D 20/48* (2013.01); *A46B 15/003* (2013.01); *A46B 2200/104* (2013.01)

(58) Field of Classification Search

CPC ..... A45D 20/12; A45D 20/48; A45D 2/001; A46B 15/003

See application file for complete search history.

(56) References Cited

U.S. PATENT DOCUMENTS

| | | | |
|---|---|---|---|
| 3,970,093 | A | 7/1976 | Lardenois |
| 4,411,281 | A | 10/1983 | Doern |
| 4,877,042 | A | 10/1989 | Downey |

(Continued)

FOREIGN PATENT DOCUMENTS

| | | | |
|---|---|---|---|
| AU | 366597 | S | 1/2016 |
| AU | 2014326405 | A1 | 3/2016 |

(Continued)

OTHER PUBLICATIONS

Tymo Ring. (n.d.). Tymo Beauty. https://tymobeauty.com/products/tymo-hair-straightening-comb, 8 pages.

(Continued)

*Primary Examiner* — Edelmira Bosques
*Assistant Examiner* — Bao D Nguyen
(74) *Attorney, Agent, or Firm* — Mintz, Levin, Cohn, Ferris, Glovsky and Popeo, P.C.

(57) ABSTRACT

A hair care appliance and methods for drying and/or styling hair are provided. The hair care appliance includes a handle having an inlet and a body coupled to the handle and having a plurality of outlets. The handle can include a fan assembly and a motor assembly and the applicant can include one or more heater assemblies. In one embodiment, the appliance includes at least one heater assembly extending along the body between the proximal and distal ends. In some aspects, the at least one heater assembly can longitudinally separate a first plurality of bristles from a second plurality of bristles. In other embodiments, a baffle for directing airflow is provided. In other embodiments, the appliance is configured to switch between hair drying and hair heating modes.

16 Claims, 13 Drawing Sheets

(56) References Cited

U.S. PATENT DOCUMENTS 4,936,027 A 6/1990 Tsuji
5,448,677 A * 9/1995 Fell ..... A45D 20/12 73/204.25
6,094,837 A * 8/2000 Cantor ..... A45D 20/12 34/97
6,895,975 B2 5/2005 Hafemann
6,996,916 B2 2/2006 Cafaro
7,300,244 B2 11/2007 Baugh et al.
7,308,899 B2 12/2007 Kampel
7,356,943 B2 4/2008 Behbehani
D609,857 S 2/2010 Schmitz
7,661,174 B2 2/2010 Park
7,909,572 B2 3/2011 Suzuki et al.
D648,893 S 11/2011 Kaizuka
8,056,568 B2 11/2011 Ruckart
8,066,017 B1 11/2011 Born et al.
D650,942 S 12/2011 Choi
8,209,877 B2 7/2012 Smal
D670,027 S 10/2012 Choi
8,302,246 B2 11/2012 Chudzik et al.
8,544,477 B1 10/2013 Laaly
D694,952 S 12/2013 Choi
8,601,713 B2 12/2013 Gaillard et al.
8,602,038 B2 12/2013 Choi
8,607,804 B2 12/2013 De Benedictis
D698,994 S 2/2014 Xu
8,678,752 B2 3/2014 Delvaux et al.
D705,483 S 5/2014 Xu
D711,042 S 8/2014 Kaizuka
D715,995 S 10/2014 Dyson et al.
D715,996 S 10/2014 Dyson et al.
D716,492 S 10/2014 Dyson et al.
8,967,525 B2 3/2015 Schneider et al.
D729,447 S 5/2015 Gammack
D729,448 S 5/2015 Gammack
D729,978 S 5/2015 Bates et al.
D729,979 S 5/2015 Gammack
D730,575 S 5/2015 Bates et al.
D730,576 S 5/2015 Gammack
D731,117 S 6/2015 Bates et al.
9,046,109 B2 6/2015 Duke et al.
9,144,286 B2 9/2015 Courtney et al.
D741,544 S 10/2015 Gammack
9,173,468 B2 11/2015 Moloney et al.
9,237,789 B2 1/2016 Prehodka
9,282,799 B2 3/2016 Courtney et al.
9,282,800 B2 3/2016 Courtney et al.
D757,361 S 5/2016 Gammack
D757,362 S 5/2016 Dyson et al.
D758,010 S 5/2016 Bates et al.
D758,011 S 5/2016 Gammack
D758,012 S 5/2016 Bates et al.
9,410,553 B2 8/2016 Ions et al.
9,414,662 B2 8/2016 Moloney et al.
9,420,864 B2 8/2016 Gammack et al.
D766,504 S 9/2016 Hollinger
D771,310 S 11/2016 He
9,493,903 B2 11/2016 Yu et al.
9,510,395 B2 11/2016 Coulton et al.
D775,419 S 12/2016 Stephens et al.
9,516,938 B2 12/2016 Richmond et al.
9,521,891 B2 12/2016 Ragosta et al.
D776,345 S 1/2017 Tang
9,578,945 B2 2/2017 Han
D782,731 S 3/2017 Smith et al.
D782,732 S 3/2017 Smith et al.
D782,733 S 3/2017 Smith et al.
D782,735 S 3/2017 Stephens et al.
D782,736 S 3/2017 Stephens et al.
9,596,916 B2 3/2017 Moloney et al.
D784,614 S 4/2017 Stephens et al.
D785,240 S 4/2017 Smith et al.
D785,241 S 4/2017 Stephens et al.
9,609,941 B2 4/2017 Ragosta et al.
9,687,058 B2 6/2017 Atkinson
D791,407 S 7/2017 Smith et al.
9,808,061 B2 11/2017 Ford et al.
9,808,065 B2 11/2017 Moloney et al.
D804,828 S 12/2017 Gulamani
9,877,562 B2 1/2018 Guy-Rabi et al.
D811,009 S 2/2018 Smith et al.
9,901,155 B2 2/2018 Nuzzo et al.
D815,837 S 4/2018 Zhou
9,936,788 B2 4/2018 Stephens et al.
9,936,789 B2 4/2018 Stephens et al.
D818,717 S 5/2018 Gulamani
10,016,040 B2 7/2018 Courtney et al.
10,021,951 B2 7/2018 Bobillier et al.
10,028,574 B2 7/2018 Rennette
10,064,470 B2 9/2018 Warne
D830,630 S 10/2018 Chia et al.
10,085,537 B2 10/2018 Maclaine
10,085,538 B2 10/2018 Saunders et al.
10,117,491 B2 11/2018 Moloney et al.
10,143,285 B2 12/2018 Stephens et al.
10,165,844 B2 1/2019 Stephens et al.
10,186,822 B2 1/2019 Hogan
D843,652 S 3/2019 Mcluckie et al.
D843,653 S 3/2019 Teyu et al.
D843,654 S 3/2019 Teyu et al.
10,226,112 B2 3/2019 Kerr et al.
10,238,199 B2 3/2019 Stephens et al.
D847,421 S 4/2019 Tappenden et al.
D847,422 S 4/2019 Tappenden et al.
D847,423 S 4/2019 Tappenden et al.
D847,424 S 4/2019 Tappenden et al.
D847,425 S 4/2019 Tappenden et al.
D847,426 S 4/2019 Tappenden et al.
D848,063 S 5/2019 Tappenden et al.
D848,064 S 5/2019 Tappenden et al.
D848,065 S 5/2019 Heffer et al.
D848,066 S 5/2019 Coulton et al.
D848,067 S 5/2019 Heffer et al.
D848,068 S 5/2019 Heffer et al.
D848,675 S 5/2019 Chia et al.
D850,001 S 5/2019 Coulton et al.
10,278,471 B2 5/2019 Shelton et al.
D852,415 S 6/2019 Coulton et al.
D852,416 S 6/2019 Coulton et al.
10,306,965 B2 6/2019 Wilkinson et al.
10,326,330 B2 6/2019 Kursula et al.
D853,130 S 7/2019 Dunn
D853,637 S 7/2019 Coulton et al.
D853,638 S 7/2019 Tappenden et al.
D853,639 S 7/2019 Tappenden et al.
D853,640 S 7/2019 Tappenden et al.
D853,641 S 7/2019 Tappenden et al.
D853,642 S 7/2019 Coulton et al.
D854,745 S 7/2019 Chia et al.
D855,252 S 7/2019 Coulton et al.
D856,579 S 8/2019 Chia et al.
D856,580 S 8/2019 Chia et al.
10,390,599 B1 8/2019 James et al.
D858,875 S 9/2019 Liu
D860,528 S 9/2019 Atkinson et al.
D860,529 S 9/2019 Atkinson et al.
D860,530 S 9/2019 Atkinson et al.
D860,531 S 9/2019 Atkinson et al.
D860,532 S 9/2019 Atkinson et al.
10,398,218 B2 9/2019 Exley
10,422,350 B2 9/2019 Herrou et al.
D865,286 S 10/2019 Atkinson et al.
10,441,049 B2 10/2019 Douglas et al.
10,441,050 B2 10/2019 Blanc et al.
10,443,626 B2 10/2019 Mielke et al.
10,470,545 B2 11/2019 Thiebaut et al.
10,480,527 B2 11/2019 Van Houten et al.
D869,763 S 12/2019 Atkinson et al.
D869,764 S 12/2019 Atkinson et al.
10,506,859 B2 12/2019 Putzer et al.
10,575,617 B2 3/2020 Courtney et al.
10,602,826 B2 3/2020 Wilkinson et al.
10,605,269 B2 3/2020 Stadler et al.
D882,957 S 5/2020 Huang

(56) References Cited

U.S. PATENT DOCUMENTS

| | | | |
|---|---|---|---|
| D884,966 | S | 5/2020 | Flynn et al. |
| D885,663 | S | 5/2020 | Flynn et al. |
| 10,648,486 | B2 | 5/2020 | Daly |
| 10,660,417 | B2 | 5/2020 | Bennett |
| 10,687,595 | B2 | 6/2020 | Courtney et al. |
| 10,702,037 | B2 | 7/2020 | Boateng et al. |
| 10,729,218 | B2 | 8/2020 | Childe et al. |
| 10,765,191 | B2 | 9/2020 | Stephens et al. |
| 10,786,061 | B2 | 9/2020 | Thiebaut et al. |
| D898,363 | S | 10/2020 | Gan |
| D901,772 | S | 11/2020 | Huang |
| D902,482 | S | 11/2020 | Koenemann et al. |
| D903,941 | S | 12/2020 | Koenemann et al. |
| 10,856,638 | B2 | 12/2020 | Paliobeis et al. |
| 10,869,529 | B2 | 12/2020 | Chia et al. |
| 10,874,186 | B2 | 12/2020 | Macpherson et al. |
| D908,956 | S | 1/2021 | Kwok |
| 10,925,371 | B2 | 2/2021 | Hein |
| 10,935,039 | B2 | 3/2021 | Kedelty et al. |
| 10,939,747 | B2 | 3/2021 | Mikitovic et al. |
| 10,943,394 | B2 | 3/2021 | Charraud et al. |
| 10,968,921 | B2 | 4/2021 | Cho et al. |
| 10,973,298 | B2 | 4/2021 | Kennedy et al. |
| D917,886 | S | 5/2021 | Ma |
| D921,291 | S | 6/2021 | Zhang |
| D923,874 | S | 6/2021 | Kirkbride et al. |
| 11,019,903 | B2 | 6/2021 | Potts et al. |
| 11,033,088 | B2 | 6/2021 | Atkinson et al. |
| 11,044,979 | B2 | 6/2021 | Maclaine |
| 11,071,365 | B2 | 7/2021 | Maclaine et al. |
| D930,363 | S | 9/2021 | Xu |
| 11,134,764 | B2 | 10/2021 | Xiao et al. |
| 11,143,197 | B2 | 10/2021 | Müller et al. |
| 11,154,125 | B2 | 10/2021 | Mercier |
| 11,168,924 | B2 | 11/2021 | Naicker et al. |
| 11,172,745 | B2 | 11/2021 | Tam et al. |
| 11,213,174 | B2 | 1/2022 | Yoo et al. |
| 11,224,274 | B2 | 1/2022 | Kim et al. |
| 11,242,863 | B2 | 2/2022 | Xu et al. |
| 11,253,040 | B2 | 2/2022 | Kim et al. |
| D952,941 | S | 5/2022 | Lam |
| 11,333,163 | B2 | 5/2022 | Adachi |
| D955,636 | S | 6/2022 | Zou |
| 11,425,979 | B2 | 8/2022 | Conrad |
| 11,425,980 | B2 | 8/2022 | Conrad |
| 11,457,713 | B2 | 10/2022 | Conrad |
| 11,503,900 | B2 | 11/2022 | Chen |
| 11,506,221 | B2 | 11/2022 | Takemoto et al. |
| 11,510,472 | B2 | 11/2022 | Julemont |
| 11,512,709 | B2 | 11/2022 | Iwata et al. |
| D973,370 | S | 12/2022 | Guo |
| 11,517,091 | B2 | 12/2022 | Conrad |
| 11,519,427 | B2 | 12/2022 | Johnson |
| D974,042 | S | 1/2023 | Hinds |
| D975,918 | S | 1/2023 | Yuan |
| D979,253 | S | 2/2023 | Janowick et al. |
| 11,589,662 | B2 | 2/2023 | Kim et al. |
| 2005/0121049 | A1 | 6/2005 | Rizzuto |
| 2008/0041409 | A1 | 2/2008 | Leung |
| 2010/0251499 | A1 | 10/2010 | Bigio |
| 2010/0263223 | A1 | 10/2010 | Wynne |
| 2013/0008461 | A1 | 1/2013 | Wang et al. |
| 2017/0273422 | A1 | 9/2017 | Heffer et al. |
| 2017/0273428 | A1 | 9/2017 | Nicolson et al. |
| 2017/0273429 | A1 | 9/2017 | Nicolson et al. |
| 2017/0273430 | A1 | 9/2017 | Heffer et al. |
| 2018/0055182 | A1 | 3/2018 | Thompson et al. |
| 2018/0153294 | A1 | 6/2018 | Thomas |
| 2018/0271247 | A1 | 9/2018 | Marston et al. |
| 2019/0223572 | A1 | 7/2019 | Ahrens |
| 2019/0380463 | A1 | 12/2019 | Guerreiro et al. |
| 2020/0093254 | A1 | 3/2020 | Charraud et al. |
| 2020/0146413 | A1 | 5/2020 | Mathiaszyk et al. |
| 2020/0260831 | A1 | 8/2020 | Buttery et al. |
| 2020/0397111 | A1 | 12/2020 | Bouchar |
| 2021/0007458 | A1 | 1/2021 | Nilsen |
| 2021/0030130 | A1 | 2/2021 | Kelly |
| 2021/0259382 | A1 | 8/2021 | Goldman et al. |
| 2021/0285328 | A1 | 9/2021 | Mahmoodilari et al. |
| 2021/0307474 | A1 | 10/2021 | Conrad |
| 2021/0315352 | A1 | 10/2021 | Kim et al. |
| 2021/0315354 | A1 | 10/2021 | Kim et al. |
| 2021/0381518 | A1 | 12/2021 | Horton et al. |
| 2022/0022621 | A1 | 1/2022 | Friedman et al. |
| 2022/0167733 | A1 | 6/2022 | Kaizuka |
| 2022/0218095 | A1* | 7/2022 | Paliobeis ..... A45D 2/002 |
| 2022/0220971 | A1 | 7/2022 | Takeishi et al. |
| 2022/0287448 | A1 | 9/2022 | Durham |
| 2022/0354231 | A1 | 11/2022 | Pulfrey et al. |
| 2022/0361646 | A1 | 11/2022 | Valle |
| 2022/0408895 | A1 | 12/2022 | Lelieveld |

FOREIGN PATENT DOCUMENTS

| | | | |
|---|---|---|---|
| AU | 2014326407 | A1 | 3/2016 |
| AU | 2014389903 | A1 | 9/2016 |
| AU | 2014326406 | B2 | 5/2017 |
| CA | 966300 | A | 4/1975 |
| CA | 2436797 | A1 | 7/2002 |
| CA | 2638149 | C | 7/2012 |
| CA | 2830038 | A1 | 11/2012 |
| CA | 2853972 | A1 | 5/2013 |
| CA | 2777328 | A1 | 11/2013 |
| CA | 2620197 | C | 4/2014 |
| CA | 160766 | S | 9/2015 |
| CA | 2928266 | A1 | 10/2016 |
| CA | 163169 | S | 12/2016 |
| CA | 163170 | S | 12/2016 |
| CA | 163184 | S | 12/2016 |
| CA | 166089 | S | 12/2016 |
| CA | 166229 | S | 12/2016 |
| CA | 178458 | A | 12/2019 |
| CN | 1149946 | C | 5/2004 |
| CN | 101662969 | B | 8/2011 |
| CN | 101379300 | B | 11/2011 |
| CN | 102885460 | A | 1/2013 |
| CN | 205671726 | U | 11/2016 |
| CN | 205993856 | U | 3/2017 |
| CN | 104856417 | B | 1/2018 |
| CN | 207168088 | U | 4/2018 |
| CN | 108078142 | A | 5/2018 |
| CN | 207544575 | U | 6/2018 |
| CN | 207544576 | U | 6/2018 |
| CN | 108425882 | A | 8/2018 |
| CN | 104273917 | B | 10/2018 |
| CN | 108669760 | A | 10/2018 |
| CN | 104510137 | B | 11/2018 |
| CN | 108968289 | A | 12/2018 |
| CN | 109512119 | A | 3/2019 |
| CN | 105559311 | B | 4/2019 |
| CN | 106194831 | B | 5/2019 |
| CN | 109820321 | A | 5/2019 |
| CN | 110037425 | A | 7/2019 |
| CN | 110215039 | A | 9/2019 |
| CN | 110215040 | A | 9/2019 |
| CN | 107028321 | B | 10/2019 |
| CN | 110836193 | A | 2/2020 |
| CN | 210055005 | U | 2/2020 |
| CN | 210055006 | U | 2/2020 |
| CN | 110934408 | A | 3/2020 |
| CN | 111075759 | A | 4/2020 |
| CN | 111109814 | A | 5/2020 |
| CN | 111297027 | A | 6/2020 |
| CN | 111456956 | A | 7/2020 |
| CN | 211154233 | U | 8/2020 |
| CN | 111657652 | A | 9/2020 |
| CN | 107847031 | B | 11/2020 |
| CN | 211984221 | U | 11/2020 |
| CN | 212185556 | U | 12/2020 |
| CN | 106560115 | B | 1/2021 |
| CN | 212280319 | U | 1/2021 |
| CN | 213096652 | U | 5/2021 |
| CN | 113017227 | A | 6/2021 |
| CN | 113243646 | A | 8/2021 |

(56) References Cited

FOREIGN PATENT DOCUMENTS

| | | | | |
|---|---|---|---|---|
| CN | 109788833 | B | 11/2021 | |
| CN | 112012959 | B | 12/2021 | |
| CN | 113738698 | A | 12/2021 | |
| CN | 215014274 | U | 12/2021 | |
| CN | 114439776 | A | 5/2022 | |
| CN | 114483649 | A | 5/2022 | |
| CN | 110630540 | B | 7/2022 | |
| CN | 112401438 | B | 7/2022 | |
| CN | 114698915 | A | 7/2022 | |
| CN | 107536224 | B | 8/2022 | |
| CN | 218127365 | U | 12/2022 | |
| CN | 113972758 | B | 2/2023 | |
| CN | 113668440 | B | 3/2023 | |
| DE | 102012220756 | B4 | 2/2017 | |
| DE | 202014011043 | U1 | 7/2017 | |
| EP | 0300281 | A1 | 1/1989 | |
| EP | 1435806 | B1 | 3/2007 | |
| EP | 1534097 | B1 | 9/2007 | |
| EP | 1342427 | B1 | 11/2007 | |
| EP | 1779745 | B1 | 5/2008 | |
| EP | 1839520 | B1 | 11/2008 | |
| EP | 2305061 | B1 | 10/2012 | |
| EP | 2336569 | B1 | 12/2012 | |
| EP | 2312967 | B1 | 4/2013 | |
| EP | 2428132 | B1 | 10/2013 | |
| EP | 2520189 | B1 | 7/2014 | |
| EP | 2520190 | B1 | 7/2014 | |
| EP | 2736375 | B1 | 9/2015 | |
| EP | 2745729 | B1 | 11/2015 | |
| EP | 2736374 | B1 | 6/2017 | |
| EP | 2965651 | B1 | 8/2017 | |
| EP | 3058842 | B1 | 1/2018 | |
| EP | 3016545 | B1 | 6/2018 | |
| EP | 3158890 | B1 | 8/2018 | |
| EP | 3024352 | B1 | 10/2018 | |
| EP | 3240455 | B1 | 11/2018 | |
| EP | 3172985 | B1 | 4/2019 | |
| EP | 3852572 | A1 | 7/2021 | |
| EP | 3308669 | B1 | 11/2021 | |
| EP | 3926173 | A1 | 12/2021 | |
| EP | 3949803 | A1 | 2/2022 | |
| EP | 3137774 | B1 | 5/2022 | |
| EP | 4003089 | A1 | 6/2022 | |
| EP | 4178394 | A1 | 5/2023 | |
| FR | 2147682 | A5 | 3/1973 | |
| GB | 2093526 | B | 3/1983 | |
| GB | 2232588 | B | 1/1993 | |
| GB | 2515812 | B | 2/2016 | |
| GB | 2521144 | B | 12/2016 | |
| GB | 2503683 | B | 4/2017 | |
| GB | 2524304 | B | 4/2017 | |
| GB | 2539439 | B | 5/2018 | |
| GB | 2548816 | B | 9/2019 | |
| GB | 2548812 | B | 10/2019 | |
| GB | 2565698 | B | 1/2020 | |
| GB | 2548813 | B | 2/2020 | |
| GB | 2548819 | B | 5/2020 | |
| GB | 2557958 | B | 5/2020 | |
| GB | 2586037 | A | 2/2021 | |
| GB | 2576017 | B | 4/2021 | |
| GB | 2587605 | A | 4/2021 | |
| GB | 2581371 | B | 9/2021 | |
| GB | 2581372 | B | 12/2021 | |
| GB | 2595974 | A | 12/2021 | |
| GB | 2599384 | A | 4/2022 | |
| GB | 2602162 | A * | 6/2022 | ..... A45D 20/12 |
| GB | 2580416 | B | 9/2022 | |
| GB | 2599385 | B | 3/2023 | |
| IL | 236277 | | 2/2015 | |
| IL | 236278 | | 2/2015 | |
| IL | 236278 | A | 2/2015 | |
| IL | 247694 | | 11/2016 | |
| IL | 252183 | | 7/2017 | |
| JP | 2004089266 | A | 3/2004 | |
| JP | 2004154555 | A | 6/2004 | |
| JP | 2013059580 | A | 4/2013 | |
| JP | 2015531650 | A | 11/2015 | |
| JP | 3206808 | U | 9/2016 | |
| JP | 1611708 | S | 8/2018 | |
| JP | 1608559 | S | 9/2018 | |
| JP | 1614531 | S | 9/2018 | |
| JP | 1617402 | S | 11/2018 | |
| JP | 1618289 | S | 11/2018 | |
| JP | 1618303 | S | 11/2018 | |
| JP | 1618610 | S | 11/2018 | |
| JP | 1620038 | S | 12/2018 | |
| JP | 3220334 | U | 2/2019 | |
| JP | 2019024680 | A | 2/2019 | |
| JP | 1625926 | S | 3/2019 | |
| JP | 3226032 | U | 4/2020 | |
| JP | 6971157 | B2 | 11/2021 | |
| JP | 2022027590 | A | 2/2022 | |
| JP | 7089712 | B2 | 6/2022 | |
| KR | 200464223 | Y1 | 12/2012 | |
| KR | 20160021294 | A | 2/2016 | |
| KR | 101713997 | B1 | 3/2017 | |
| KR | 101771206 | B1 | 8/2017 | |
| KR | 101804648 | B1 | 12/2017 | |
| KR | 20180017194 | A | 2/2018 | |
| KR | 20180128480 | A | 12/2018 | |
| KR | 20190122864 | A | 10/2019 | |
| KR | 20190126159 | A | 11/2019 | |
| SG | 11201510235 | Y | 1/2016 | |
| TW | D165066 | S | 12/2014 | |
| TW | D165472 | S | 1/2015 | |
| TW | D165837 | S | 2/2015 | |
| TW | M494533 | U | 2/2015 | |
| TW | D172734 | S | 12/2015 | |
| TW | D172735 | S | 12/2015 | |
| TW | D172736 | S | 12/2015 | |
| TW | D172968 | S | 1/2016 | |
| TW | D172969 | S | 1/2016 | |
| TW | D172971 | S | 1/2016 | |
| TW | D172972 | S | 1/2016 | |
| TW | D176885 | S | 7/2016 | |
| TW | D176886 | S | 7/2016 | |
| TW | D176887 | S | 7/2016 | |
| TW | D176888 | S | 7/2016 | |
| TW | D177510 | S | 8/2016 | |
| TW | D177511 | S | 8/2016 | |
| TW | D190861 | S | 6/2018 | |
| TW | D190862 | S | 6/2018 | |
| TW | D190863 | S | 6/2018 | |
| TW | D192752 | S | 9/2018 | |
| TW | D192754 | S | 9/2018 | |
| TW | D192755 | S | 9/2018 | |
| TW | D192756 | S | 9/2018 | |
| TW | D192757 | S | 9/2018 | |
| TW | D192758 | S | 9/2018 | |
| TW | D192760 | S | 9/2018 | |
| TW | D192761 | S | 9/2018 | |
| TW | D192762 | S | 9/2018 | |
| TW | D192763 | S | 9/2018 | |
| TW | D192764 | S | 9/2018 | |
| TW | D192765 | S | 9/2018 | |
| TW | D194528 | S | 12/2018 | |
| TW | D195016 | S | 12/2018 | |
| TW | D195017 | S | 12/2018 | |
| TW | D195018 | S | 12/2018 | |
| TW | D195019 | S | 12/2018 | |
| TW | M571687 | U | 12/2018 | |
| WO | 2004045338 | A2 | 6/2004 | |
| WO | 2007120223 | A1 | 10/2007 | |
| WO | 2007134408 | A1 | 11/2007 | |
| WO | 2009015802 | A1 | 2/2009 | |
| WO | 2014001879 | A1 | 1/2014 | |
| WO | 2014046613 | A1 | 3/2014 | |
| WO | 2016001658 | A1 | 1/2016 | |
| WO | 2016108014 | A1 | 7/2016 | |
| WO | 2017077221 | A1 | 5/2017 | |
| WO | 2017077222 | A1 | 5/2017 | |
| WO | 2017079762 | A9 | 8/2017 | |
| WO | 2018002515 | A1 | 1/2018 | |
| WO | 2018069697 | A1 | 4/2018 | |

(56) References Cited

FOREIGN PATENT DOCUMENTS

| | | | |
|---|---|---|---|
| WO | 2018077708 | A1 | 5/2018 |
| WO | 2018169709 | A1 | 9/2018 |
| WO | 2020089580 | A1 | 5/2020 |
| WO | 2020109751 | A1 | 6/2020 |
| WO | 2020169849 | A1 | 8/2020 |
| WO | 2021060625 | A1 | 4/2021 |
| WO | 2021230480 | A1 | 11/2021 |
| WO | 2019067716 | A9 | 12/2021 |
| WO | 2022012272 | A1 | 1/2022 |
| WO | 2022069857 | A1 | 4/2022 |
| WO | 2022069858 | A1 | 4/2022 |
| WO | 2022069859 | A1 | 4/2022 |
| WO | 2022069860 | A1 | 4/2022 |
| WO | 2022069864 | A1 | 4/2022 |
| WO | 2022069865 | A1 | 4/2022 |
| WO | 2022069881 | A1 | 4/2022 |
| WO | 2022090683 | A1 | 5/2022 |
| WO | 2022136866 | A2 | 6/2022 |
| WO | 2022171714 | A1 | 8/2022 |
| WO | 2023025057 | A1 | 3/2023 |

OTHER PUBLICATIONS

Invitation to Pay Additional Fees received for PCT Application No. PCT/US2023/085090, mailed on Mar. 22, 2024, 20 pages.
U.S. Appl. No. 18/098,104, filed Jan. 17, 2023, Hot Brush.
U.S. Appl. No. 18/155,877, filed Jan. 18, 2023, Hot Brush.

* cited by examiner

HOT BRUSH

FIELD

The present application relates to hair care appliances and methods for drying and/or styling hair.

BACKGROUND

Hair care appliances are devices used for drying and styling of hair. Hair care appliances can include a variety of components operable to provide a fluid flow via a fluid flow path extending through the device. The fluid flow path receives ambient air and directs the ambient air through the hair care appliance via a motor and fan assembly. The fluid flow path is directed across a heating assembly to generate heated air at an outlet of the hair care appliance. Air is expelled from the hair care appliance via the fluid flow path to enable a user to dry and/or heat hair during styling.

SUMMARY

In general, hair care devices are provided for use in drying and/or styling hair. In one embodiment, a hair care appliance is provided and includes a handle having proximal and distal ends with an air inlet at the proximal end. The handle can include a fan assembly and a motor assembly. The hair care appliance can also include a body having proximal and distal ends with an inner lumen extending therethrough. The proximal end of the body can be coupled to the distal end of the handle. The body can include a first plurality of bristles positioned along a first surface extending between the proximal and distal ends. The first surface can include a first plurality of outlets therein for allowing airflow therethrough from the inner lumen of the body. In some embodiments, the body can also include a second plurality of bristles positioned along a second surface extending between the proximal and distal ends. The second surface can be positioned on an opposite side of the body from the first surface. The second surface can include a second plurality of outlets therein for allowing airflow therethrough from the inner lumen of the body. The body can also include at least one heater assembly extending along the body between the proximal and distal ends. In some embodiments, the at least one heater assembly can longitudinally separate the first plurality of bristles from the second plurality of bristles. The at least one heater assembly can include a plurality of heating plates spaced longitudinally from one another.

In one aspect, the at least one heater assembly can include a first heater assembly positioned on a first side of the body and a second heater assembly positioned on a second side of the body opposite the first side of the body.

In another embodiment, the body can have a cross-sectional shape that is elliptical.

In another embodiment, the hair care appliance can include a third heater assembly disposed in the handle and configured to heat air drawn into the handle through the air inlet by the fan assembly.

In another embodiment, the hair care appliance can include a user interface positioned on the handle and configured to provide a visual indication that indicates an operating status of each heating element of the at least one heater assembly.

In another embodiment, the at least one heater assembly can include a plurality of heat insulating spacers positioned adjacent to the plurality of heating plates, a heating element, and a heat transfer element configured to convey heat from the heating element to the plurality of heating plates. The heat transfer element can include a base adjacent to the heating element and the plurality of heating plates can extend radially from the base. A height of respective plates of the plurality of heating plates can be less than a height of respective spacers of the plurality of heat insulating spacers. In other aspects, the first or second heater assemblies can include a thermal cutoff switch.

In another embodiment, the first and second plurality of bristles can be interspersed with the first and second plurality of outlets on the first and second surfaces of the body. In another embodiment, at least a portion of at least one of the first and second plurality bristles can include a collar surrounding a base of the bristle.

In another embodiment, a hair care appliance is provided and can include a handle having a fan assembly and a first heater assembly disposed therein. The fan assembly can be configured to draw air into the handle through an air inlet and to direct air along a longitudinal airflow path into the heater assembly. The heater assembly can be configured to heat the air. The hair care appliance can also include a body having a tubular shape coupled to the handle and having an inner lumen configured to receive heated air from the heater assembly. The body can include a plurality of outlets positioned there around and extending there along. The body can include at least one heater assembly extending longitudinally along the body and dividing the plurality of outlets into at least a first portion of outlets and a second portion of outlets. The at least one heater assembly can include a plurality of longitudinally spaced heating plates configured to receive hair there between.

In one aspect, the body can include a third portion of outlets positioned between the first and second portion of outlets. In another aspect, the third portion of outlets can direct airflow toward the at least one heater assembly.

In another embodiment, the body can include at least one support element positioned at a proximal end of the body and extending radially outward from the body.

In another embodiment, a hair care appliance is provided and includes an elongate housing having an inner lumen extending longitudinally there through. The housing can include a handle portion and a body portion. The hair care appliance can also include a fan assembly configured to direct air longitudinally through the inner lumen along an airflow path. The hair care appliance can include a first plurality of outlets positioned in a first region of the body portion configured to dry hair. The hair care appliance can also include a plurality of heating plates spaced longitudinally along the body and positioned in a second region of the body portion configured to heat hair. The second region can be spaced radially from the first region.

In one embodiment, the first region can include a first pair of opposing surfaces of the body portion. In another embodiment, a second plurality of outlets can be positioned in a third region of the body, the third region being radially spaced from the first region and the second region. In another embodiment, the second region can include a second pair of opposing surfaces of the body portion. In another embodiment, the elongate housing can be circular, oval, or elliptically shaped.

DESCRIPTION OF DRAWINGS

These and other features will be more readily understood from the following detailed description taken in conjunction with the accompanying drawings, in which.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Various exemplary hair care appliances and methods for using the same are provided herein. The exemplary hair care appliances described herein can include a hot brush used for drying, heating, and styling hair. In general, the hair care appliance is in the form of a hair dryer that has an elongate generally cylindrical configuration with a handle coupled to a body. The body can include regions configured for drying hair, with the regions arranged about a circumference of the body, and regions configured for heating hair to aid in straightening the hair.

To enable drying of hair, an inlet in the handle can be fluidically coupled to outlets in the body along a fluid flow path extending along an inner lumen of the hair care appliance. Air can be drawn into the inlet via a fan assembly located in the handle and can be heated via a heater assembly located in the handle. Air can be transmitted through the heater assembly in the handle into an inner lumen of the body. The body can include a baffle positioned therein and configured to evenly distribute the air along the length of the body to outlets located in surfaces of the body. The outlets can be located at one or more locations in the drying regions of the body. The body can also include bristles positioned within the drying regions of the body. The bristles and the outlets of the body enable a user to brush their hair as they are drying their hair.

To enable heating of hair for straightening, the heating regions include one or more heater assemblies. The heater assemblies can include heated plates configured to receive and heat hair therebetween. The heater assemblies can also include spacers configured to allow hair to pass therethrough and into contact with the heated plates. The spacers can protect a user's scalp, head, or hands from contacting the heated plates. The heated plates and spacers enable a user to apply heat to their hair as they are brushing their hair.

Figure 1:
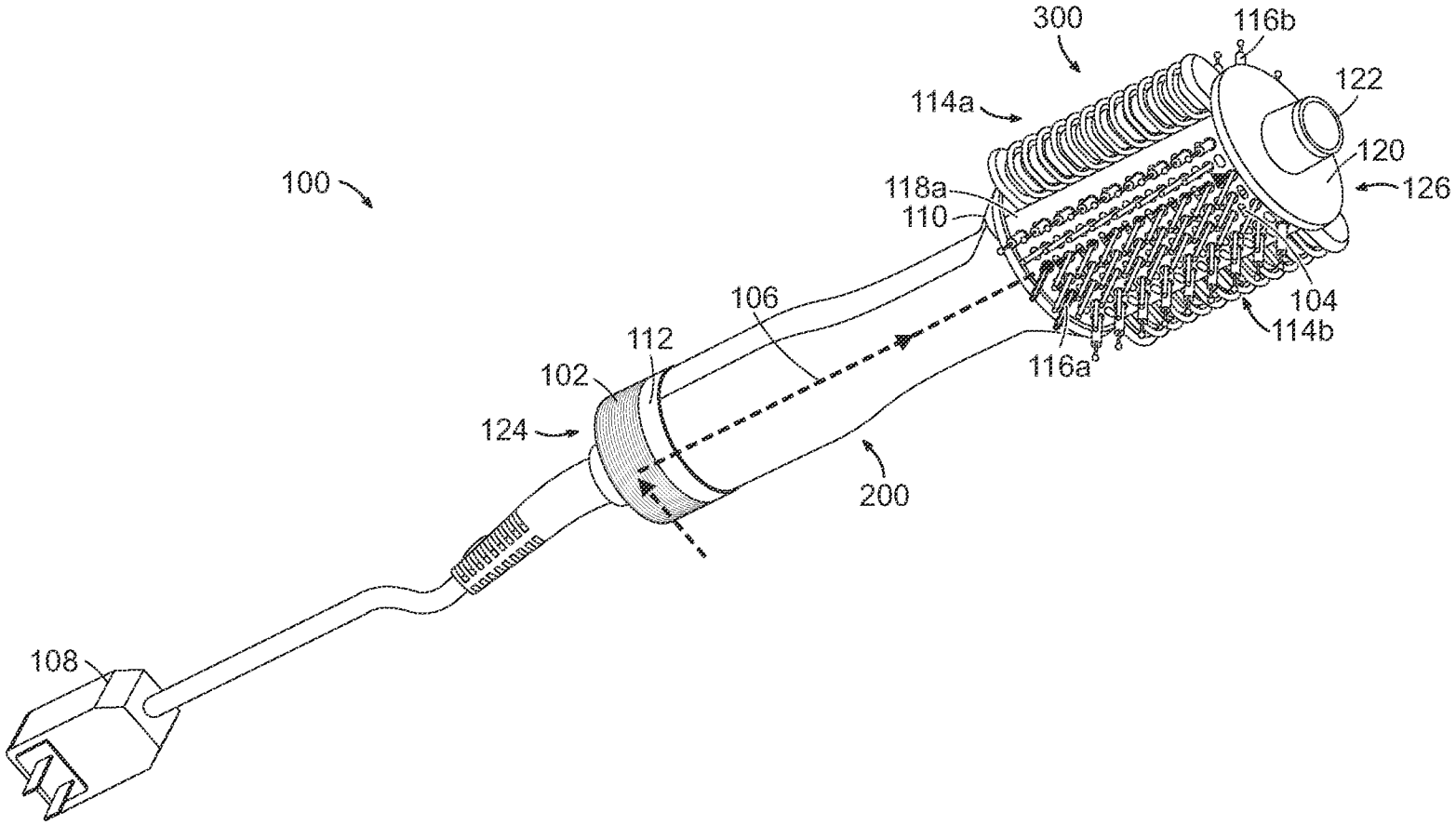
FIG. 1 is a perspective view of one exemplary embodiment of a hair care appliance described herein.

FIG. 1 illustrates one exemplary embodiment of a hair care appliance 100 having a handle 200 coupled to a body 300. As shown, the handle 200 includes an inlet 102 at a proximal end 124 of the hair care appliance 100 and outlets 104 arranged in the body 300. A fluid flow path 106 extends between the inlet 102 and the outlets 104. The hair care appliance 100 can include a cord or cable extending from the proximal end of the handle 200 and having electrical wires extending there through. A terminal end of the cord or cable can include a plug 108 or similar connector configured to couple to a power source for allowing power to be delivered to the internal components of the hair care appliance 100. The hair care appliance can also include one or more user interfaces 110 on the handle 200 configured to allow user control of the device, and/or to provide visual indications or notifications in regard to an operational mode of the hair care appliance 100. In some embodiments, the handle 200 can include a rotatable selector 112 or similar switch-type element configured to select an operational mode from one or more mode settings. In some embodiments, the rotatable selector 112 can be configured as an actuator.

Figure 2:
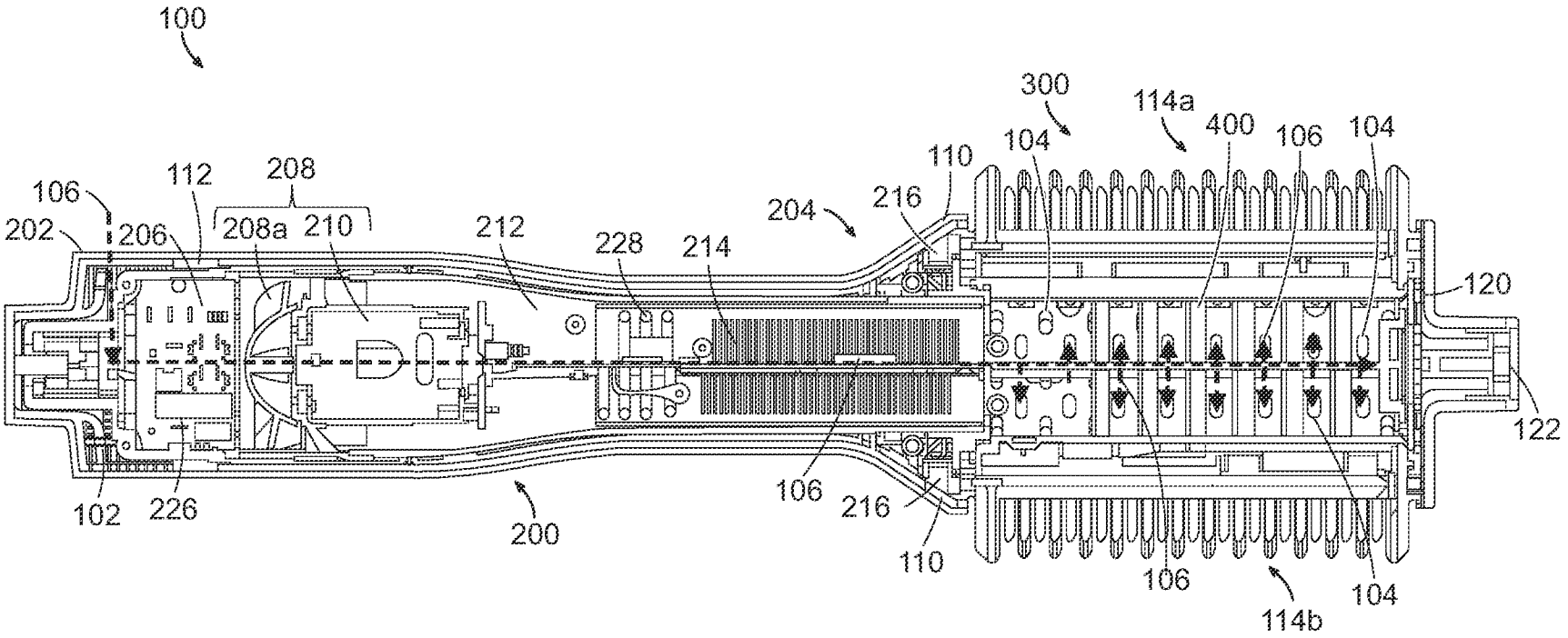
FIG. 2 is a side cross-sectional view of the hair care appliance of FIG. 1 including a handle and a body.

FIG. 2 illustrates the internal components of the handle 200, and as shown the handle 200 includes a printed circuit board (PCB) 206 at the proximal end 202 of the handle 200. The PCB 206 can include at least one data processor that can be communicatively coupled to a non-transitory computer-readable medium storing instructions, which when executed, cause the at least one data processor to perform operations associated with one or more operational modes of the hair care appliance 100. The PCB 206 can be communicatively coupled to a fan assembly 208 disposed in the handle 200 and including a fan 208*a* and a motor 210. The fan assembly 208 can draw air into the hair care appliance 100 through the inlet 102 at the proximal end 202 of the handle 200. The air can pass along the fluid flow path 106 through an inner lumen 212 to a heater assembly 214 positioned in the handle 200. Air can be heated by the heater assembly 214 and can continue along the fluid flow path 106 into the body 300. The PCB 206 can also be communicatively coupled to a heater assembly 214, and to one or more additional heating assemblies provided within the heating regions 114 of the body 300, as will be discussed in further detail below. The PCB 206 can be further communicatively coupled to the rotatable selector 112 on the handle 200 for receiving a user input selecting an operational mode of the hair care appliance 100. The PCB 206 can also include a controller 226 communicatively coupled to the fan assembly 208, the heater assembly 214, and heater assemblies 500. The controller 226 can be configured to activate or deactivate the fan assembly 208, the heater assembly 214, and heater assemblies 500. The controller 226 can be further communicatively coupled to the user interface 110 and the rotatable selector 112. Responsive to user inputs provided via the rotatable selector 112, the controller 112 can generate first control signals selectively activating or deactivating the fan assembly 208, the heater assembly 214, and heater assemblies 500 and second control signals further controlling the user interface 110 to be selectively activated or deactivated in response to the first control signals. The rotatable selector 112 can be configured to actuate the heater assembly 214 in addition to or alternatively to the heater assembly 500. The handle 200 can include a number of additional components to aid in operation of the device and/or to improve performance. For example, as shown in FIG. 2, the handle 200 can include a heater coil 228 that can act as a resistor to reduce voltage supplied to the motor 210. When the motor 210 is on, the heater coil 228 is energized and heats air flowing therethrough.

Figure 3:
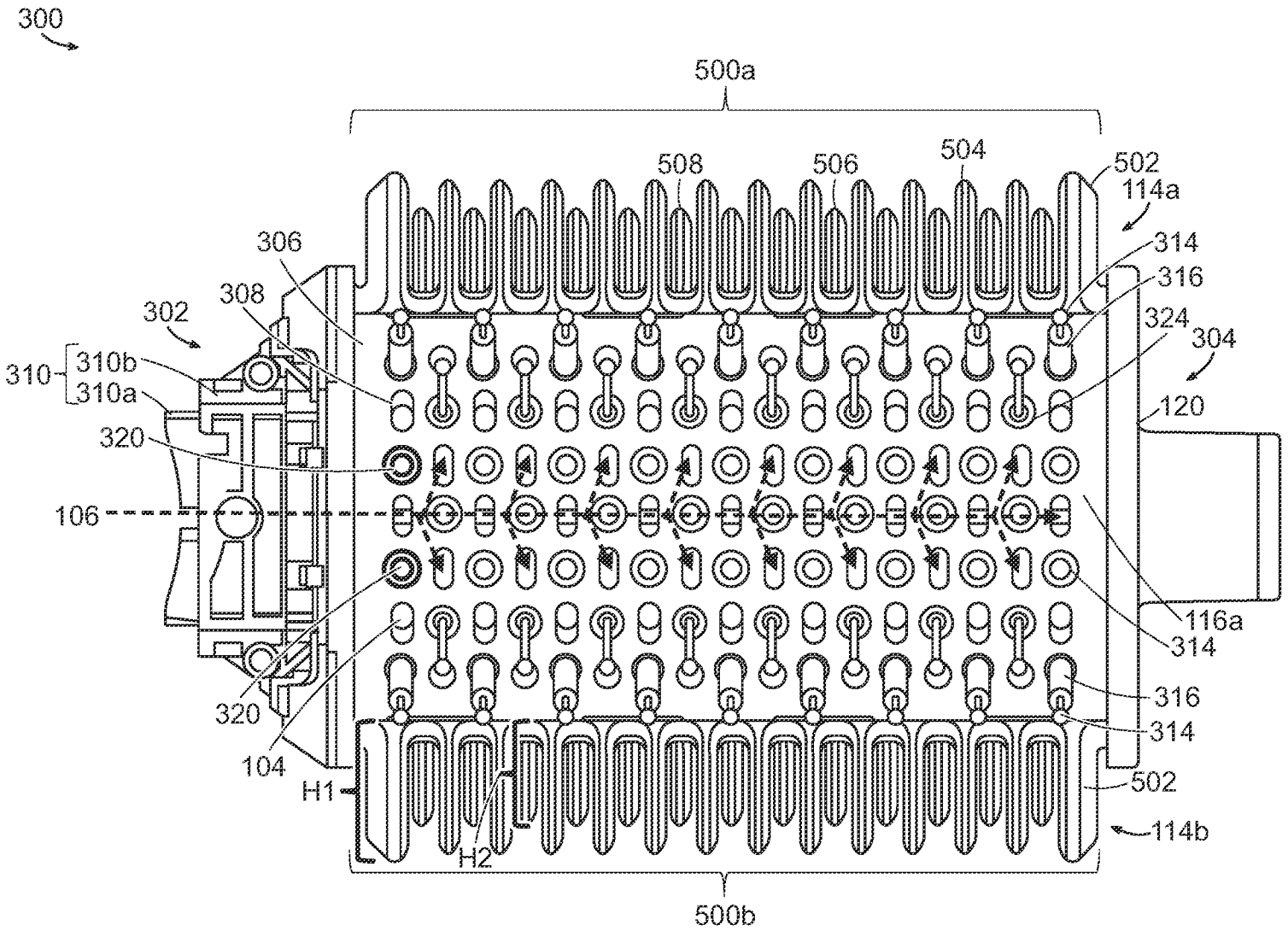
FIG. 3 is a side view of a body of the hair care appliance of FIG. 1 with the handle removed showing a drying region of the hair care appliance.
Figure 4B:
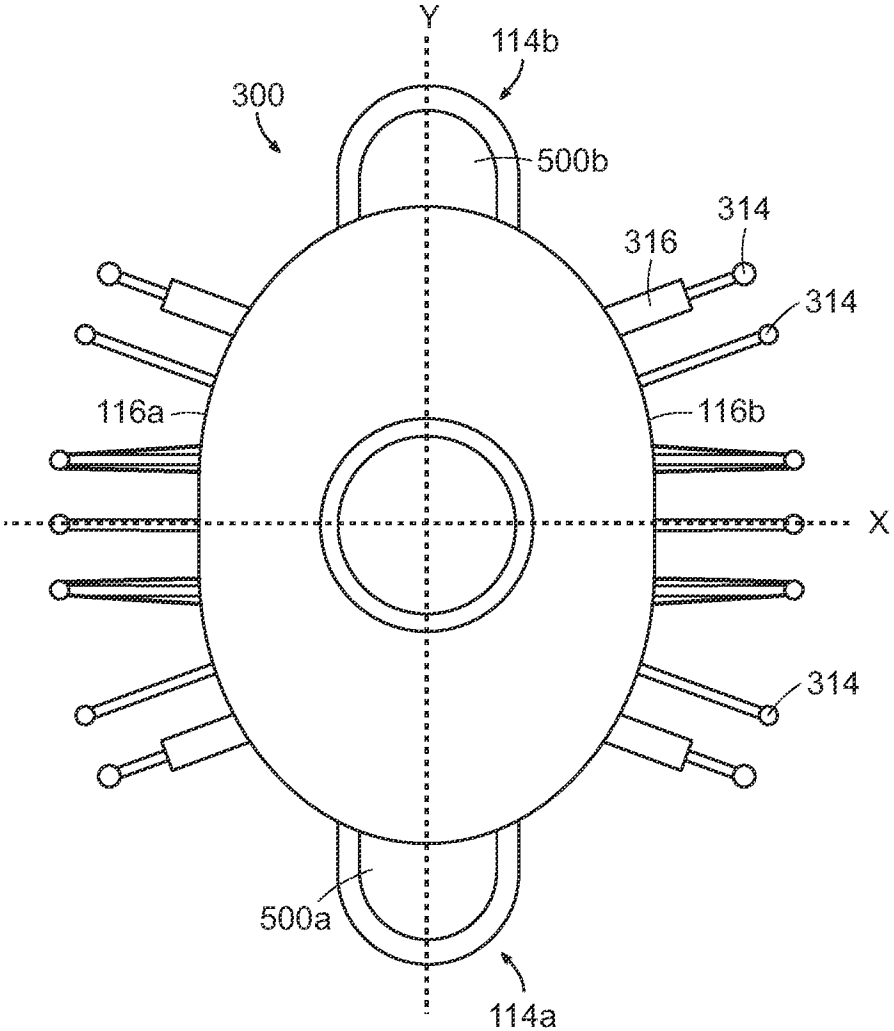
FIG. 4B is an end view of the body of FIG. 3.
Figure 4A:
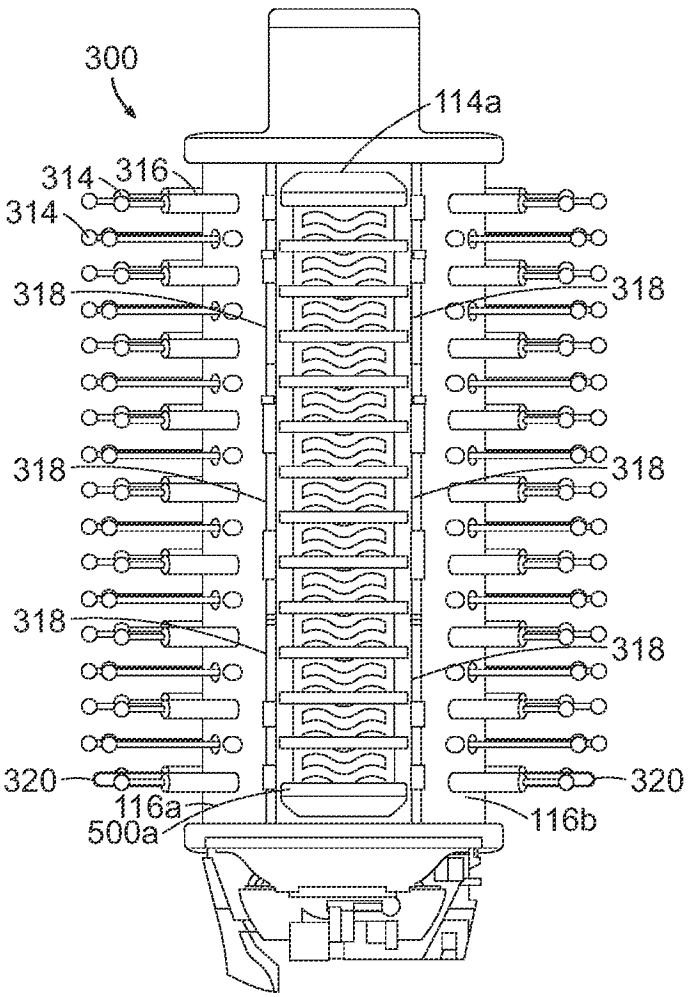
FIG. 4A is a side view of the body of FIG. 3 showing a heating region of the hair care appliance.

The body 300 of the hair care appliance 100 is shown in more detail in FIGS. 3 and 4A-4B, and generally has an elongate configuration with a proximal end 302 and a distal end 304. The proximal end 302 of the body 300 can be coupled to the distal end 204 of the handle 200. In some embodiments, the body 300 can couple to the handle 200 via a housing of the heater assembly 214. As previously indicated, the body 300 can include one or more drying regions 116, such as drying region 116*a* shown in FIG. 3, and one or more heating regions, such as heating regions 114*a* and 114*b*.

The body 300 of the hair care appliance 100 can have a cross-sectional shape that is circular, oval, or elliptical. As shown in FIGS. 4A and 4B, the body 300 is elliptically shaped and includes two heating regions 114 (e.g., heating regions 114*a* and 114*b*) disposed around a circumference of the body 300. In some embodiments, first heating region 114*a* and second heating region 114*b* can be located on opposing surfaces or portions of the body 300. The body 300 can further include two drying regions 116 (e.g., drying regions 116*a* and 116*b*) disposed around the circumference of the body 300. In some embodiments, first drying region 116*a* and the second drying region 116*b* can be located at opposing surfaces or portions of the body 300. The drying regions 116*a*, 116*b* can be positioned between the heating regions 114*a*, 114*b* such that the heating regions 114*a*, 114*b* are separated by the drying regions 116*a*, 116*b*. As a result, the drying regions 116*a*, 116*b* are offset 90 degrees with respect to the heating regions 114*a*. 114*b*. As shown in FIG. 4B, the heating regions 114*a* and 114*b* are positioned with respect to a major axis Y extending through the elliptically-shaped body 300 and the drying regions 116*a* and 116*b* are positioned with respect with respect to a minor axis X extending through the elliptically-shaped body 300. A person skilled in the art will appreciate that in other embodiments, the hair care appliance 100 can include a single heating region 114 and a single drying region 116. The location of the heating regions 114 and the drying regions 116 can enhance the case of use for a user styling hair. The arrangement of the heating regions 114 and the drying regions 116 requires minimal manipulation of the hair care appliance 100 as the user switches between drying hair and heating hair. A user can style hair using either of a heating region 114 or a drying region 116 merely by rotating the hair care appliance along a longitudinal axis extending through a length of the hair care appliance 100. As a result, the hair care appliance 100 can provide faster styling of hair without requiring the need for separate devices to dry hair and heat hair.

Figure 4C:
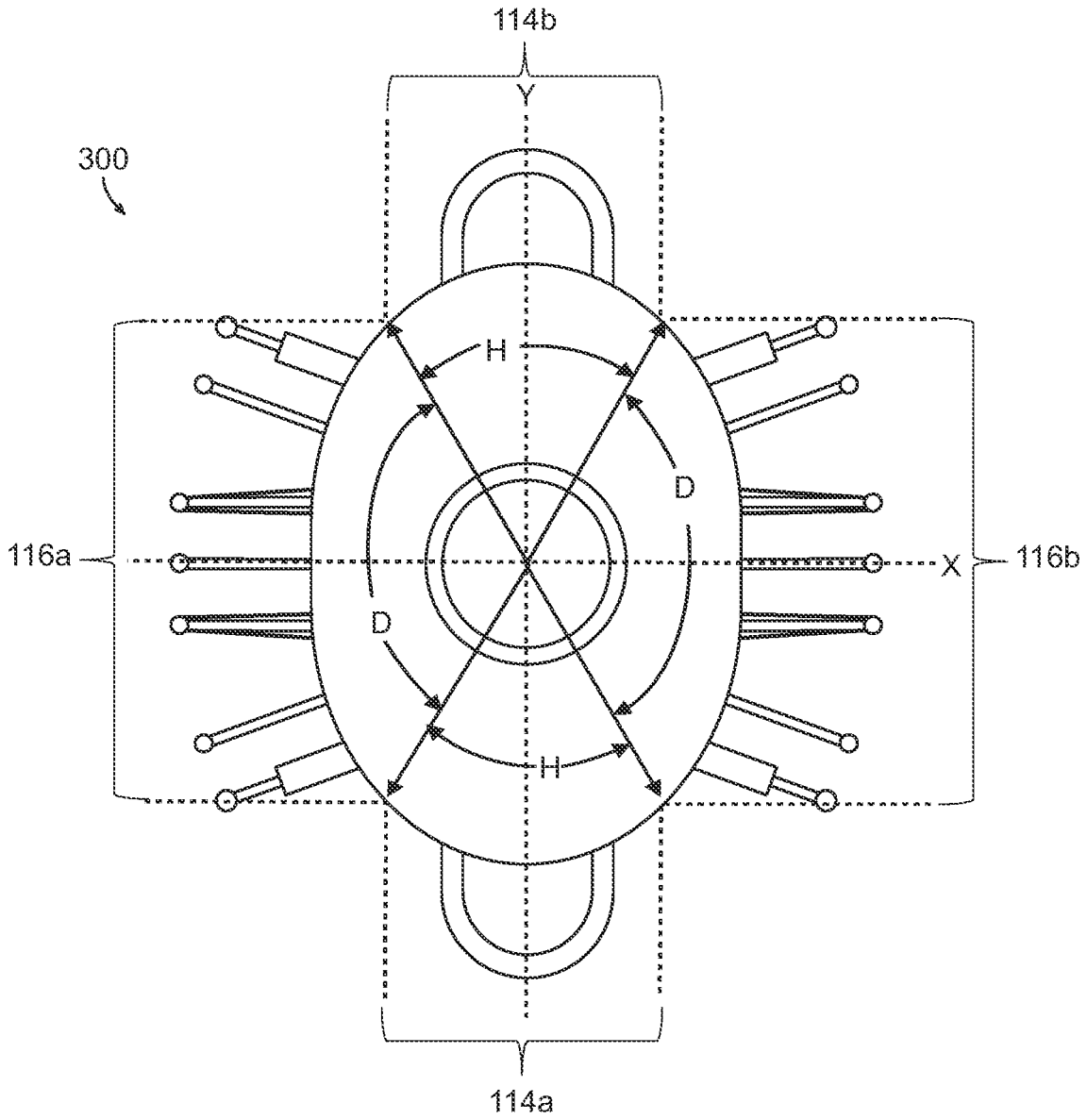
FIG. 4C is an end view of the body of FIG. 3 illustrating a configuration of drying regions and heating regions.

FIG. 4C illustrates a cross-sectional view of the body 300 showing the heating regions 114*a*. 114*b* and drying regions 116*a*, 116*b* disposed about its circumference. As shown, the heating regions 114 are arranged on the major axis Y and the drying regions 116 are arranged on the minor axis X. In this way, the drying regions 116 extend along a greater length of the perimeter than the heating regions 114, which can advantageously allow the bristles 314 to engage a greater volume of hair. As a result, a greater amount of tension can be applied to the volume of hair as the hair is pulled through the heating regions 114 when styling. Maximizing the surface area of the drying regions 116 to include a greater number of bristles 314 can improve the performance of styling hair using the heating regions 114.

In some embodiments, the heating regions 114 can be positioned about the circumference of the body 300 at locations corresponding to angle H as measured from the central axis of the body 300. The angle H can be between about 20-30, 25-35, 30-40, 35-45, 40-50, 45-55, or 50-60 degrees such that the heating regions 114 can occupy about 10-15, 15-20, 20-25, 25-30, 30-35 or 35-40% of the circumference of the body 300.

In some embodiments, the drying regions 116 can be positioned about the circumference of the body 300 adjacent to and orthogonal from the heating regions 114. The drying regions 116 can be positioned at locations of the circumference of the body corresponding to angle D as measured from the central axis of the body 300. The angle D can be between about 160-150, 155-145, 150-140, 145-135, 140-130, 135-125, or 130-120 degrees such that the drying regions can occupy about 60-65, 65-70, 70-75, 75-80, 80-85, or 85-90% of the circumference of the body 300.

Figure 5B:
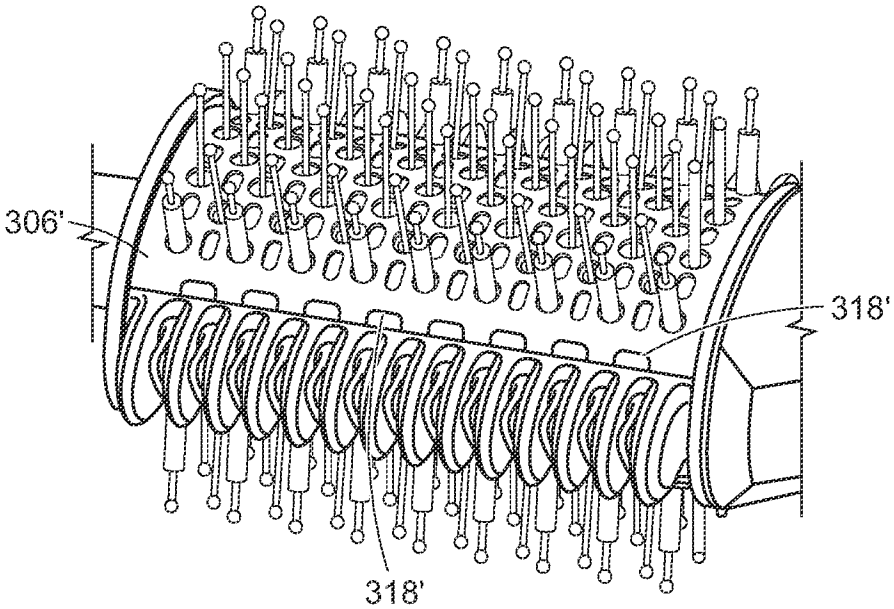
FIG. 5B is a side view of an alternative embodiment of the cover of the body of FIG. 3.
Figure 5A:
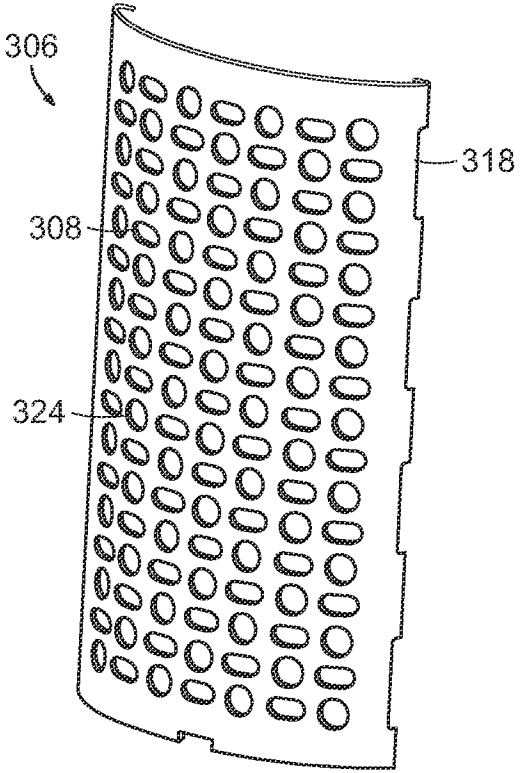
FIG. 5A is a perspective view of a cover of the body of FIG. 3.
Figure 5C:
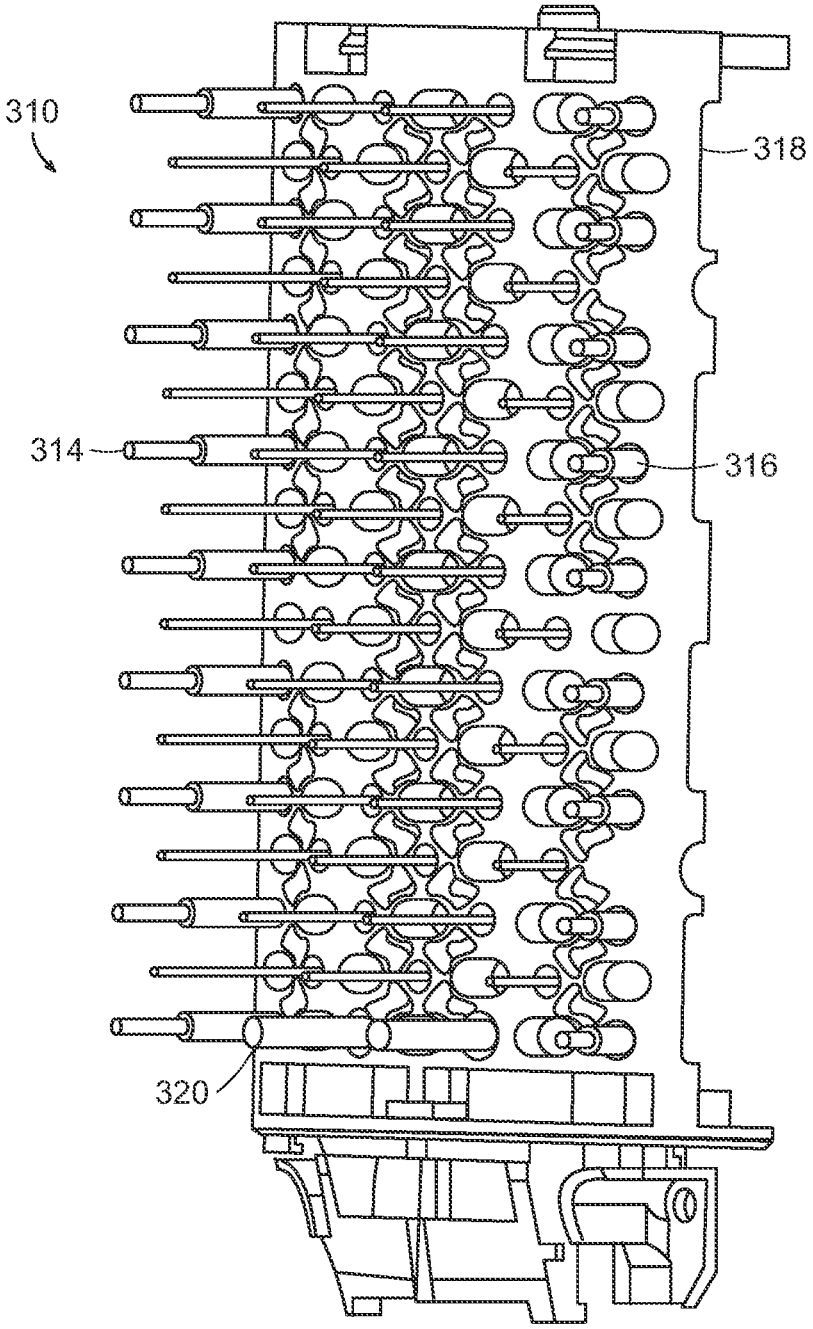
FIG. 5C is a perspective view of a bristle frame assembly of the body of FIG. 3.

The drying regions 116 of the body 300 can be formed from various components. As shown in FIGS. 5A, 5B, and 5C, which illustrate components of only one drying region, the body 300 includes a cover 306 and a bristle frame assembly 310. The illustrated components are representative of both drying regions 116*a*, 116*b*. As shown, the cover 306 is in the form of a hemi-elliptic cylinder. The cover 306 can include a coating configured to retain and evenly distribute heat over the cover 306. In some embodiments, the cover 306 can be a metal cover and can include a ceramic coating or a tourmaline coating. The cover 306 can include a plurality of cover openings 308 that form a portion of the outlets 104. Air flowing along the fluid flow path 106 can exit the body 300 via the cover openings 308 as shown in FIG. 5A. The cover 306 can also include cut-outs along the opposing longitudinal edges that, when the cover 306 is mounted on the body, define a second plurality of outlets 318 positioned adjacent to the heating regions 114. The second plurality of outlets 318 can have a variety of configurations. For example, as shown in FIG. 5A, the second plurality of outlets 318 can include a smaller number of respective outlets that are substantially longer in length. In another embodiment, shown in FIG. 5B, the cover 306' has a second plurality of outlets 318' that include a larger number of respective outlets that are substantially smaller in length. A variety of non-limiting outlet shapes and arrangements are envisioned. In use, the second plurality of outlets 318 can direct air from the fluid flow path 106 toward the heater assembly 500 positioned within the heating region 114. Mating features can be positioned between the second plurality of outlets 318 to allow the cover 306 to be mounted onto the bristle frame assembly 310.

The bristle frame assembly 310, shown in FIG. 5C, likewise is generally in the form of a hemi-elliptic cylinder, however it includes end regions having a structure to facilitate mating of the first and second bristle frames 310*a*, 310*b* to one another. As shown, the bristle frame assembly 310 includes a plurality of bristles 314 that extend through bristle openings 324 in the cover 306. In some embodiments, the bristles 314 can include nylon bristles. The bristles 314 can be provided in locations such as at a central portion of the drying regions 116 for combing and detangling of hair. A portion of the bristles 314 can include a collar 316 around a base of the bristle 314. In some embodiments, the collar 316 can include an animal-fur material, such as boars hair. The collar 316 can improve distribution of oil within the hair when brushing and can increase tension on the hair before directing hair into heating regions 114. In some aspects, the portions of the bristles 314 which include the collar 316 can be provided in or around locations of the cover 306 where the drying regions 116 abut the heating regions 114. The collar 316 and the position of the portions of the bristles 314 including the collar 316 can improve grabbing, smoothing, and shining of hair when the hair is straightened via the heating regions 114.

The bristle frame assembly 310 can also include support elements 320 configured to extend radially through and away from the cover 306. As shown, two support elements 320 are positioned on the bristle frame assembly 310 adjacent the proximal end. The support elements 320 can be configured to position the body 300 off of a surface on which the hair care appliance 100 can be placed when not in use to style hair. The support elements 320 can help ensure that heating regions 114 of the body 300, e.g., heating regions 114*a* and 114*b*, which respectively include heater assemblies 500*a* and 500*b*, are located away from the surface when the hair care appliance is not being used to style a user's hair. The support elements 320 can further prevent the bristles 314 from contacting or pressing against a surface on which the hair care appliance 100 can be placed, and thus prevent deformation of the bristles 314.

In some embodiments, the plurality of bristles 314 and/or the support elements 320 can be friction fit within respective receiving portions configured on the bristle frames 310. In some embodiments, the plurality of bristles 314 and/or the support elements 320 can be retained within respective receiving portions of the bristle frames 310 via retention mechanisms, such as retainer rings.

The bristle frame assembly 310 can also include the second plurality of outlets 318 positioned longitudinally along the periphery of a drying region 116 and adjacent to a heating region 114. The second plurality of outlets 318 can form a second plurality of outlets separate from the plurality of outlets 104. The second plurality of outlets 318 can direct air along the fluid flow path 106 through the outlets 318 and toward heating regions 114. The air directed toward the heating regions 114 via outlets 318 can aid styling a user's hair while heating hair within the heating regions 114. In this way, heating and drying of hair can be provided at the same time.

Figure 5D:
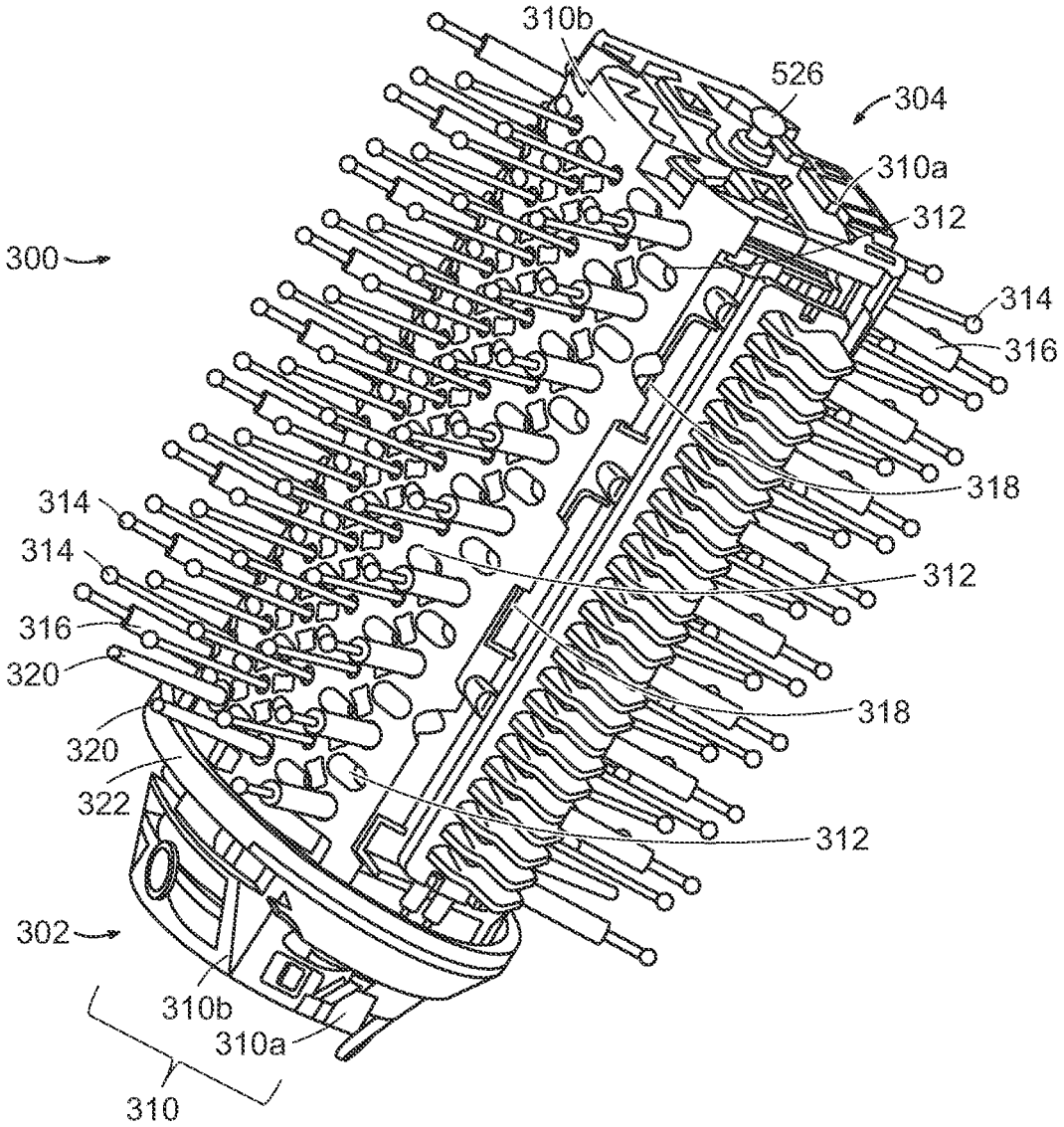
FIG. 5D is a perspective view of the body of FIG. 3 with the cover removed showing a bristle frame of the hair care appliance.

As indicated above, the first and second bristle frames 310*a*, 310*b* are configured to mate to one another. A retainer ring 322, shown in FIG. 5D, can secure the first bristle frame 310*a* and the second bristle frame 310*b* to one another at the proximal end 302 of the body 300. Collectively, the bristle frame openings 312 and the cover openings 308 can form the outlets 104. The location of the bristle frame openings 312 on the first bristle frame 310*a* and the second bristle frame 310*b* can be aligned with the locations of the cover openings 308 in the cover 306. In this way, the fluid flow path 106 can be directed through the lumen of the body 300 and through the bristle frame openings 312 and further through the cover openings 308 without disturbance in the air flow emitted from the body 300.

Turning back to FIG. 3, as previously indicated the heating regions 114 can heat hair via one or more heat assemblies 500 configured around a circumference of the body 300, such as heating region 114*a* and 114*b* as shown. For example, the body 300 can include a first heating region 114*a* including a first heater assembly 500*a* and a second heating region 114*b* including a second heater assembly 500*b*. Each heater assembly 500 can include a guard 502 including a plurality of heat insulating spacers 504 having a first height H1. Each heater assembly 500 can also include a heat transfer element 506 including a plurality of heated plates 508 having a second height H2. In some embodiments, the plurality of heated plates 508 can include a ceramic coating or a tourmaline coating to aid heat distribution and retention. In some embodiments, the first height H1 of the heat insulating spacers 504 can be greater than the second height H2 of the heating plates 508. The guard 502 can be configured to protect a user from contacting the heated plates 508. The comb-like shape of the guard 502 and the heat transfer element 506 can allow hair to be received therein and can advantageously allow a user to heat and brush hair simultaneously.

The arrangement of the heating regions 114 and the drying regions 116 on the hair care appliance 100 provide advantages not found in existing heated or non-heated hair treatment devices. For example, many existing hair treatment devices are single-use devices intended to dry hair or heat hair. In contrast, the hair care appliance 100 includes heating regions 114 provided with respect to drying regions 116 so that the hair care appliance 100 can be a multi-use device that obviates the need for separate devices to heat hair and dry hair. By configuring the location of the heating regions 114 in close proximity to the drying regions 116, a user can easily and quickly transition from drying hair to heating hair (or vice versa) by altering their grip on the handle 200 or rotating the handle 200 in their hand to bring the desired region (e.g., the heating region 116 or the drying region 114) into contact with their hair.

Existing hair straightening devices or heated brushes require a user to hold the distal end of their hair (e.g., the end furthest away from their scalp or the roots of their hair) to contact heated portions of the straightening device or heated brush with their hair. The hair care appliance 100 advantageously includes bristles 314 in the unheated drying regions 116 that can engage hair therein to create tension as the user contacts their hair with the heated plates 508 of the heating region 114. By configuring the heating assemblies 500 and heating regions 114 on portions of the body 300 having a smaller surface area, the drying regions 116 can have a larger surface area and thus hold a greater number of bristles 314. As a result, more bristles 314 can engage the hair to create increased tension on the hair as it is drawn through the heated plates 508 of the heating regions 114.

When drying wet hair, a user can place the drying region 116 in proximity of their scalp so that the bristles 314 are placed under their hair and close to the roots of their hair. The user can further roll the brush away from their scalp (e.g., from the roots toward the ends of their hair) to engage the bristles 314 and grip their hair as air flow is provided through the cover 306 to dry the user's hair.

When styling dry hair, a user can place one of the heating assemblies 500 configured in one of the heating regions 114 under their hair close to the roots. The user can create tension on the hair via the bristles 316 and can then begin to pull their hair through the plates 508 contacting the taut hair with the heated plates 508. As the user pulls their hair through the plates 508 of the first heating assembly 500*a*, the user can roll the hair care appliance 100 in their hand to engage their hair with a second heating assembly 500*b* configured opposite to the first heating assembly 500*a*. The rolling action can cause the hair to engage the second heating assembly 500*b* as it is released from the first heating assembly 500*a*. The arrangement of the heating assemblies 500 can allow a user to continuously apply heat to their hair for easy, efficient styling and heating of hair by rotating the hair care appliance 100 in their hand without requiring a separate styling and/or heating device.

Figure 6A:
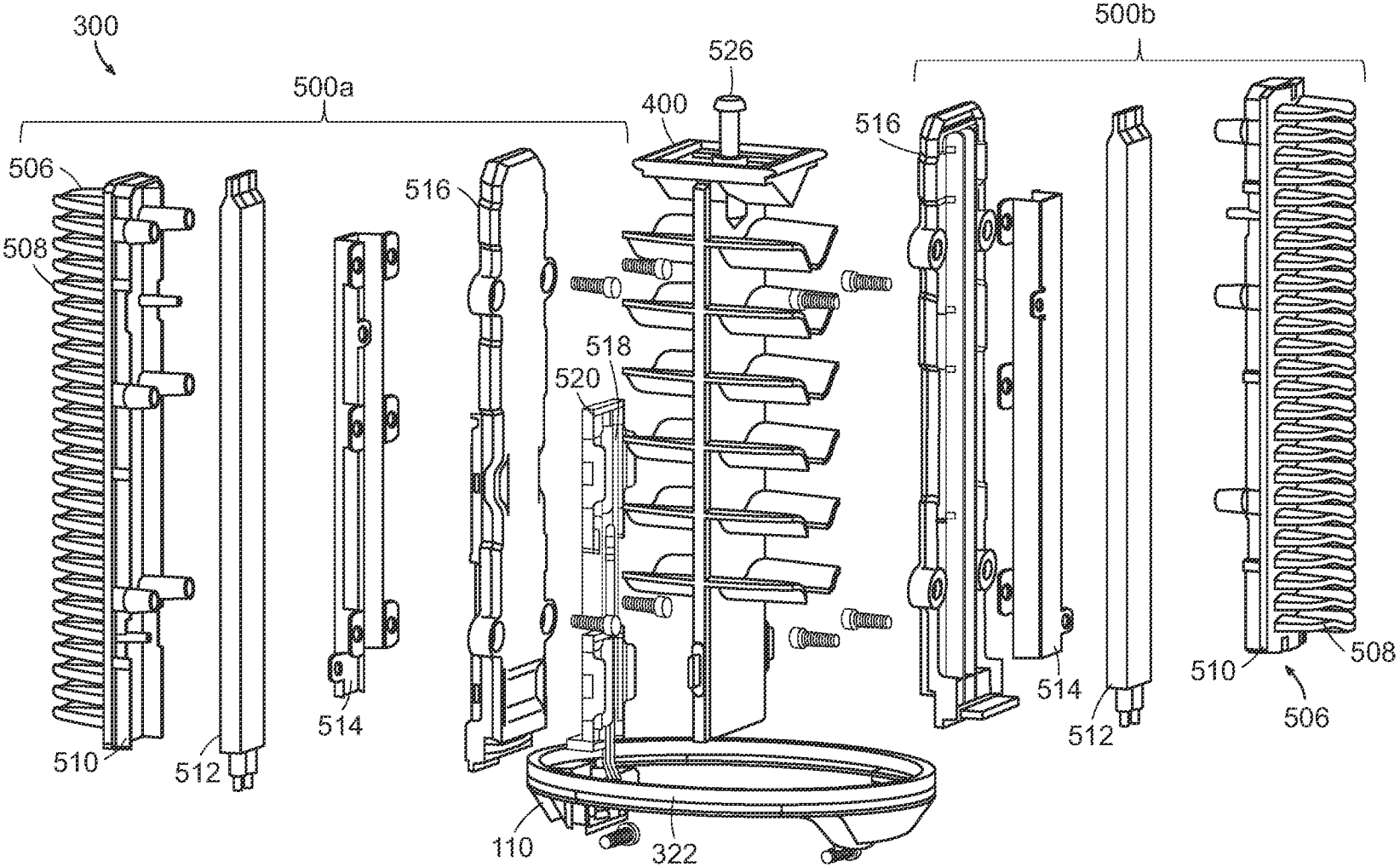
FIG. 6A is an exploded view of the body of FIG. 5D with the bristle frame removed showing heater assemblies and a baffle of the hair care appliance.
Figure 6B:
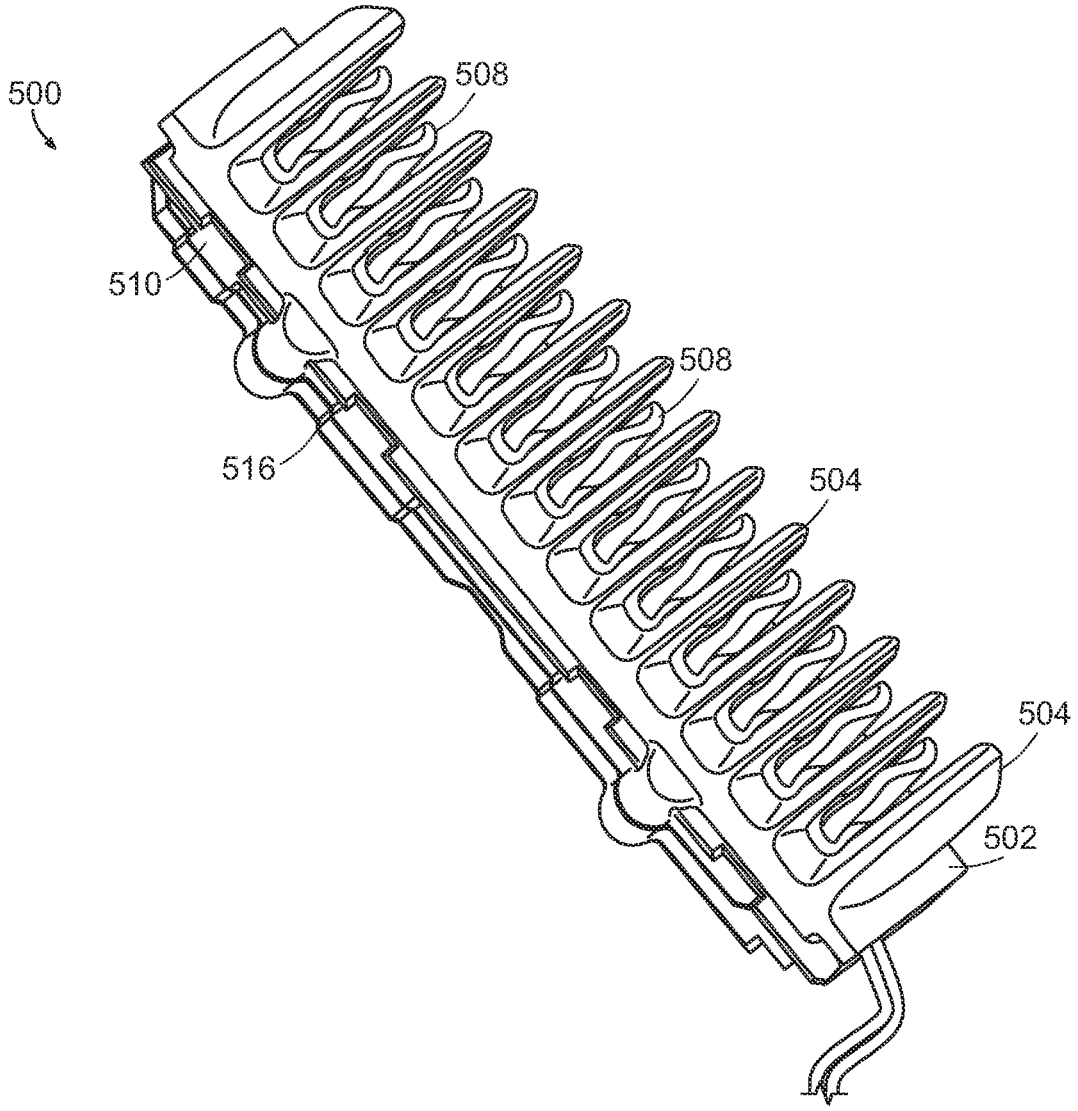
FIG. 6B is a perspective view of a heater assembly of the hair care appliance of FIG. 1.
Figure 7:
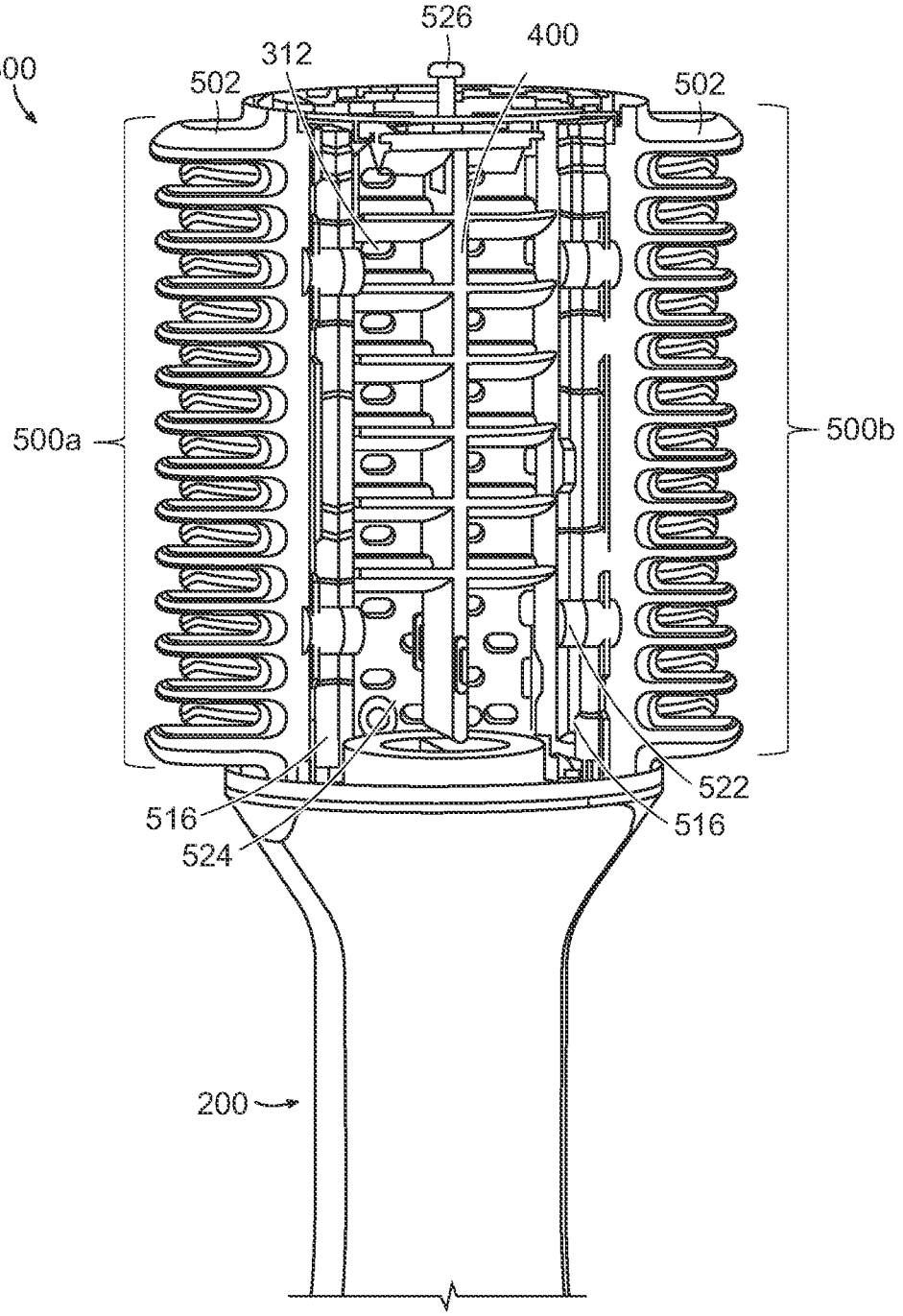
FIG. 7 is a front view of the body of FIG. 5D with the bristle frame removed showing heater assemblies and the baffle of the hair care appliance.

As shown in more detail in the exploded view in FIG. 6A, the heat transfer element 506 can include a base portion 510 and the plurality of heated plates 508 can extend radially (e.g., away from a longitudinal axis of the body 300) from the base portion 510. As shown in FIG. 6B, the shape of each plate 508 can have a non-planar profile configured to provide greater surface area in contact with hair during heating. In particular, each plate 508 has a slightly flattened S-shape such that the plates are curved. As further shown in FIG. 6A, each heater assembly 500 can also include a heating element 512 configured to generate and provide heat to the heat transfer element 506. The heat transfer element 506 can be coupled to a heating element support 514 and the heating element 512 can be positioned between the heat transfer element 506 and the heating element support 514. Each heater assembly 500 can also include a heater assembly support 516 which can couple to the guard 502 via an attachment mechanism 522 as shown in FIG. 7. Proximal ends of the heater assembly supports 516 can be received within the retainer ring 322. As shown in FIG. 6A, one or more of the heater assemblies 500 can also include a passively resettable thermal cut off (TCO) switch 518. The TCO switch 518 can advantageously provide LED control functions that are reliable, requires no active semiconductor devices, uses minimal space, and provided continuous feedback monitoring the temperature of the heating element 512. The TCO switch 518 can be communicatively coupled the user interface 110 to provide visual indications of a temperature state of the heating element 512. If the temperature of the heating element 512 is below a trigger limit of the TCO switch 518, the TCO switch 518 is in a closed state and power is provide to the LEDs 216 in the user interface 110. If the temperature of the heating element 512 is above the trigger limit of the TCO, the TCO switch 518 is in an open state and power is no longer provided to the LEDs 216 in the user interface 110. The TCO switch 518 can passively reset itself based on the temperature of the heating element 512. The TCO switch 518 can be protected by a back plate 520.

Figure 8B:
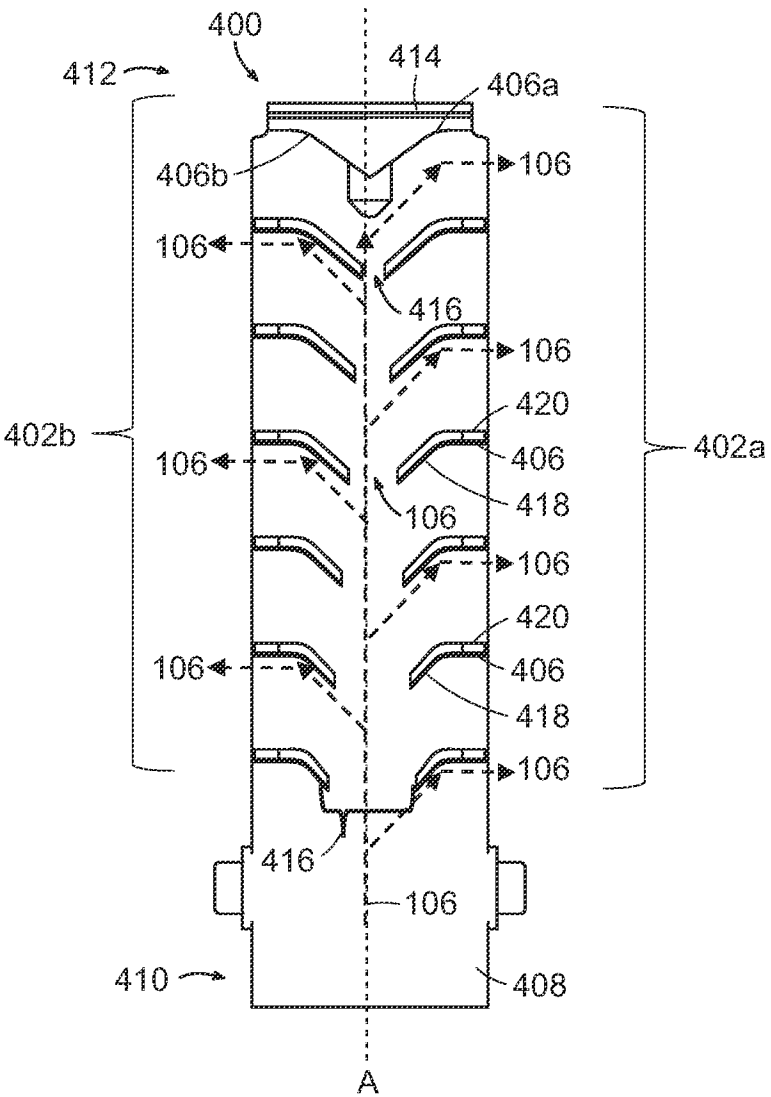
FIG. 8B is a front view of the baffle of FIG. 7.
Figure 8A:
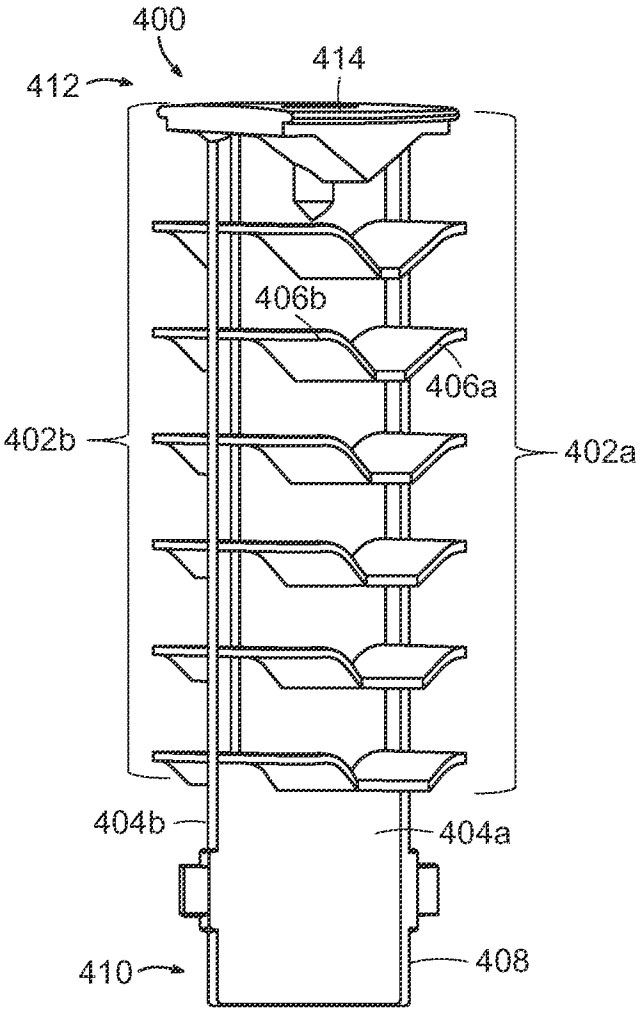
FIG. 8A is a perspective view of the baffle of FIG. 7.

As further shown in FIGS. 6A and 7, the body 300 can include a baffle 400 configured to engage and direct air flowing along the fluid flow path 106. The baffle 400 can direct the air received within the inner lumen 524 of the body 300 out through the bristle frame openings 312 and further through the cover openings 308 (e.g., through the outlets 104). As shown in FIGS. 8A and 8B, the baffle 400 includes a number of features configured to effectively divert consistent volumes of air through the outlets 104 along a length of the body 300. For example, as shown in FIG. 8A, the baffle 400 includes a plurality of vane pairs 402, such as a first plurality of vane pairs 402*a* located on a first surface 404*a* of the baffle 400 and a second plurality of vane pairs 402*b* located on a second surface 404*b*. The first surface 404*a* is opposite the second surface 404*b*. Each vane pair can include vanes 406, such as vanes 406*a* and 406*b*. The vanes 406 can project radially from a central planar element 408. The plurality of vane pairs 402 can extend along the central planar element from a proximal end 410 of the baffle 400 to the distal end 412 of the baffle. The baffle 400 can also include an attachment portion 414 at which an attachment mechanism 526 shown in FIGS. 5D, 6A, and 7, can be received through the bristle frame 310 securing the baffle 400 thereto. The attachment portion 414 can include a vane pair 406.

The fluid flow path 106 can engage the baffle 400 at the proximal end 410 of the baffle and can be diverted radially to the outlets 104 via the vane pairs 406. The respective vanes 406 can be separated from one another on the central planar element 408 by a gap 416. A width of the gap (e.g., a distance between respective vanes 406 of a vane pair 402) can decrease along the fluid flow path 106 between the proximal end 410 of the baffle 400 and the distal end 412 of the baffle 400. For example, the gap 416 can be larger at the proximal end 410 of the baffle 400 and smaller at the distal end 412 of the baffle. In this way, air pressure is increased along the fluid flow path 106 from the proximal end 410 to the distal end 412 thereby creating a uniform distribution of air provided via the outlets 104 along the entire length of the body 300.

Vanes 406 of the baffle 400 can include a fluid engagement portion 418 and a fluid diversion portion 420. The fluid engagement portion 418 can be located closest to a central axis A of the baffle 400 and the fluid diversion portion 420 can be located radially outward of the central axis A and the fluid engagement portion 418. The fluid engagement portion 418 and the fluid diversion portion 420 can be angled relative to one another and can have varying lengths for each vane 406 along the length of the baffle 400. For example, the length of the fluid engagement portion 418 of a vane 406 at the proximal end 410 of the baffle 400 can be less than the fluid engagement portion 418 of another vane 406 at the distal end 412 of the baffle 400. In this way, the fluid engagement portion 418 can progressively protrude further into the fluid flow path 106 passing along the length of the baffle 400 so that downstream vanes 406 capture portions of the air flow that were not captured by upstream vanes 406. Thus, the surface area of the vanes 406 can increase toward the distal end 412 of the baffle 400. In some embodiments, respective vane pairs of the plurality of vane pairs 402 can be spaced equally from one another along the length of the baffle 400. In some embodiments, respective vane pairs of the plurality of vane pairs 402 may not be spaced equally from one another along the length of the baffle 400 and may include more or less vane pairs at one or more locations along the central planar element 408. In some embodiments, a longitudinal position of the fluid diversion portion 420 along the length of the baffle 400 can correspond to a longitudinal position of the outlets 104 along the length of the bristle frame 310 and cover 306.

Advantageously, the design of the baffle 400 can achieve an even, uniform air flow along the entire length of the body 300, which can be challenging when an inlet is positioned perpendicularly with respect to an outlet. The arrangement of the vane pairs 402 along the length of the baffle 400 guides the air flow directly to the bristle frame openings 312 and on to the cover openings 308 (e.g., directly to the outlets 104) so that the air flow leaves the body 300 in a substantially normal direction relative to the surface of the cover 306.

Figure 9:
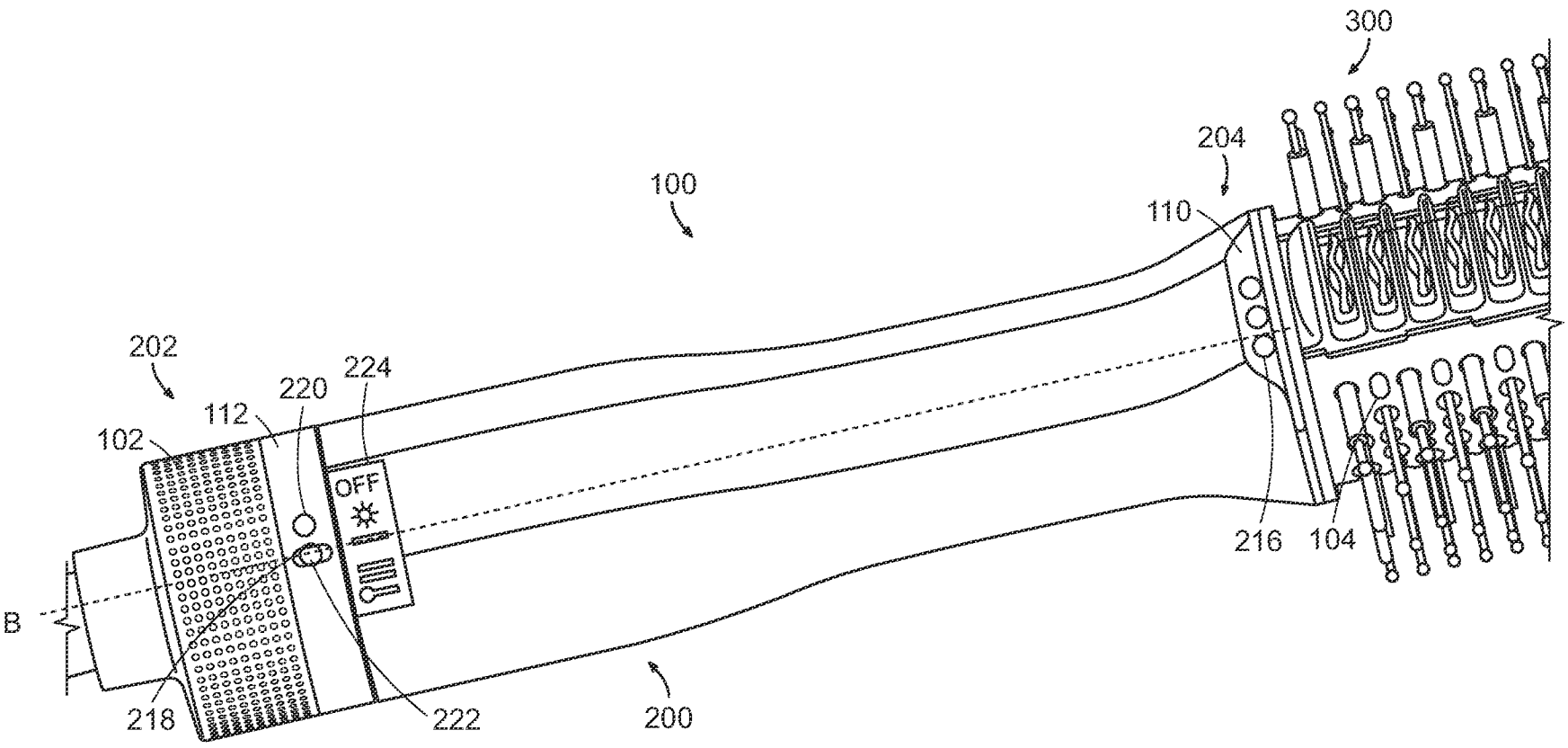
FIG. 9 is a perspective view of the handle showing a user interface of the hair care appliance.

In use, the hair care appliance 100 can be operated in one or more operational modes. The user interface 110 can display visual indications associated with the one or more operational modes to inform the user about a state of the heating element 512. For example, as shown in FIG. 9, the distal end 204 of the handle 200 can include a user interface 110 configured with one or more light emitting diodes (LEDs) 216. The LEDs 216 can illuminate responsive to a user selecting an operational mode via the rotatable selector 112 positioned at the proximal end 202 of the handle 200 and based on a closed state of the TCO switch 518. The rotatable selector 112 can include a protrusion 218 for a user to manipulate the rotatable selector 112 in a clockwise direction and a counterclockwise direction relative to a longitudinal axis B of the handle 200. The rotatable selector 112 can also include one or more LEDs 220. At least one LED 222 can be provided at a location corresponding to the protrusion 218. The handle 200 can also include a legend 224 of the operational modes of the hair care appliance 100. A person skilled in the art will appreciate that a variety of other techniques can be used to change modes and/or provide various indicators to a user.

The hair care appliance 100 can include an "OFF" mode in which the hair care appliance 100 is powered off. The hair care appliance 100 can also include a "Cool" mode in which the hair care appliance 100 provides minimally heated air from the outlets 104. In some embodiments, the temperature of the air provided in the "Cool" mode can be about 40 C. The hair care appliance 100 can further include a "Low" mode in which the hair care appliance 100 provides moderately heated air of a low temperature from the outlets 104. In some embodiments, the temperature of the air provided in the "Low" mode can be about 65 C. The hair care appliance 100 can also include a "High" mode in which the hair care appliance 100 provides substantially heated air of a high temperature from the outlets 104. In some embodiments, the temperature of the air provided in the "High" mode can be about 95 C. The hair care appliance 100 can further include a "Dry" mode in which the hair care appliance 100 heats the heater assemblies 500. The heater assemblies 500 can be heated such that a temperature of the plurality of heating plates 508 is about 190 C.

For drying hair, the hair care appliance 100 can be configured to provide air via the outlets 104 arranged within the drying regions 116. During the "Cool", "Low", and "High" modes, the fan assembly 208 generates air flow along the fluid flow path 106 at a predetermined velocity. In some embodiments, the predetermined velocity can be about 6-12 m/s. During the "Cool" mode, the heater coil 228 acts as a resistor to reduce voltage supplied to the motor 210. In this mode, when the motor 210 is on, the heater coil 228 is energized and heats air to about 40 C. During the "Low" mode, the heater assembly 214 heats the air flow to a first predetermined temperature and the air provided via the outlets 104 has a temperature of about 65 C. During the "High" mode, the heater assembly 214 heats the air flow to a second predetermined temperature and the air provided via the outlets 104 has a temperature of about 95. During the "Cool". "Low", and "High" modes, the heater assemblies 500 are not heated. During the "Dry" or "Thermal" mode, within the drying regions 116, the fan assembly 208 does not generate air flow from the outlets 104, the air flow is not heated via the heater assembly 214. Within the heating regions 114 during "Dry" or "Thermal" mode, the heated plates 508 of the heater assemblies 500 are heated to a temperature of about 190 C.

Responsive to a user selection of an operational mode, the LED 222 provided in relation to the protrusion 218 of the rotatable selector 112 can change. For example, responsive to a user selecting the "Cool", "Low", or "High" modes, the LED 222 can be illuminated with a first color or may not be illuminated. Responsive to a user selecting the "Dry" or "Thermal" mode, the LED 222 can be illuminated with a second color and a third color different than the first color. For example, the second color can be orange to indicate the heating elements 512 are in progress heating the heating elements 512 to a predetermined operational temperature. The third color can be red to indicate the heating elements 512 have reached the predetermined operating temperature. In some embodiments, the LED 220 provided in relation to the rotatable selector 112 can be configured to illuminate the rotatable selector 112 with a fourth color that is different from the first, second, or third colors.

Responsive to a user selecting the "Dry" or "Thermal" operational mode the LEDs 216 of the user interface 110 can illuminate one or more colors based on a heating state of the heating element 512. For example, when the user has selected the "Dry" or "Thermal" operational mode via the rotatable selector 112, the LEDs 216 can illuminate a first color as the heating element 512 is heated to its predetermined operational temperature. The LEDs 216 can illuminate a second color, different than the first color, when the heating element 512 has reached its predetermined operational temperature. In this way, the user interface 110 can provide a user with a visual indication of the readiness of the hair care appliance 100 for use heating hair in the "Dry" or "Thermal" operational mode.

Embodiments of the hair care appliance described herein produce a number of advantages. For example, the arrangement of heating and drying regions on the body of the hair care appliance provide an enhanced user experience for styling hair that eliminates the need for separate heating and drying devices. The baffle can provide a uniformly distributed airflow along the entire length of the body and through the outlets arranged in the drying regions. The heater assemblies can include heated tines configured for brushing and heating hair and a protective guard covering the heated tines to reduce risk of burning or injuring a user. The user interface can provide intuitive display of operational status of the heater assemblies in one or more modes of operation of the hair care appliance.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. A hair care appliance, comprising:

a body having proximal and distal ends with an inner lumen extending therethrough, the body including a first plurality of bristles positioned along a first surface extending between the proximal and distal ends, the first surface including a first plurality of outlets therein for allowing airflow therethrough from the inner lumen of the body, a second plurality of bristles positioned along a second surface extending between the proximal and distal ends, the second surface being positioned on an opposite side of the body from the first surface, and the second surface including a second plurality of outlets therein for allowing airflow therethrough from the inner lumen of the body, and at least one heater assembly extending along the body between the proximal and distal ends and including a plurality of heating plates spaced longitudinally from one another and excluding bristles therebetween, the at least one heater assembly longitudinally separating the first plurality of bristles from the second plurality of bristles, wherein the first and second surfaces lack a heater assembly.

2. The hair care appliance of claim 1, wherein the at least one heater assembly comprises a first heater assembly positioned on a first side of the body and a second heater assembly positioned on a second side of the body opposite the first side of the body.

3. The hair care appliance of claim 2, wherein the first or second heater assemblies includes a thermal cutoff switch.

4. The hair care appliance of claim 1, wherein the body has a cross-sectional shape that is elliptical.

5. The hair care appliance of claim 1, further comprising a handle coupled to the proximal end of the body, the handle having an air inlet at a proximal end, a fan assembly, a motor assembly, and a third heater assembly configured to heat air drawn into the handle through the air inlet by the fan assembly.

6. The hair care appliance of claim 5, further comprising a user interface positioned on the handle and configured to provide a visual indication that indicates an operating status of each heating element of the at least one heater assembly.

7. The hair care appliance of claim 1, wherein the at least one heater assembly includes a plurality of heat insulating spacers positioned adjacent to the plurality of heating plates, a heating element, and a heat transfer element configured to convey heat from the heating element to the plurality of heating plates.

8. The hair care appliance of claim 7, wherein the heat transfer element includes a base adjacent to the heating element and wherein the plurality of heating plates extends radially from the base.

9. The hair care appliance of claim 7, wherein a height of respective plates of the plurality of heating plates is less than a height of respective spacers of the plurality of heat insulating spacers.

10. The hair care appliance of claim 1, wherein the first and second plurality of bristles are interspersed with the first and second plurality of outlets on the first and second surfaces of the body.

11. The hair care appliance of claim 1, wherein at least a portion of at least one of the first and second plurality bristles includes a collar surrounding a base of the bristle.

12. A hair care appliance, comprising:

a handle having proximal and distal ends with an air inlet at the proximal end, the handle including a fan assembly and a motor assembly; and a body having proximal and distal ends with an inner lumen extending therethrough, the proximal end of the body being coupled to the distal end of the handle, the body including a brushing region comprising a first plurality of bristles positioned along a first surface and a second plurality of bristles positioned along a second surface opposite the first surface, the first and second surfaces including a first plurality of outlets therein for allowing airflow therethrough from the inner lumen of the body, and a heating region comprising a first heater assembly positioned along a third surface and a second heater assembly positioned along a fourth surface opposite the third surface and orthogonal to the first and second surfaces, the first and second heater assemblies having a plurality of heating plates projecting radially outward from the third and fourth surfaces and spaced longitudinally from one another, wherein the heating region excludes bristles and the first surface and the second surface exclude a heater assembly thereon.

13. The hair care appliance of claim 12, further comprising a plurality of heat insulating spacers positioned between each of the plurality of heating plates.

14. The hair care appliance of claim 13, wherein the heating region includes a heating element and a heat transfer element configured to convey heat from the heating element to the plurality of heating plates.

15. The hair care appliance of claim 13, wherein the heat insulating spacers project radially outward from the third and fourth surfaces.

16. The hair care appliance of claim 15, wherein a height of the plurality of heating plates is less than a height of the plurality of heat insulating spacers.

* * * * *